US011369838B2

(12) United States Patent
Venturella et al.

(10) Patent No.: US 11,369,838 B2
(45) Date of Patent: Jun. 28, 2022

(54) ELLIPTICAL EXERCISE MACHINE

(71) Applicant: NAUTILUS, INC., Vancouver, WA (US)

(72) Inventors: Brian Venturella, Vancouver, WA (US); Jeffrey A. Tracy, Troutdale, OR (US)

(73) Assignee: NAUTILUS, INC., Vancouver, WA (US)

( * ) Notice: Subject to any disclaimer, the term of this patent is extended or adjusted under 35 U.S.C. 154(b) by 31 days.

(21) Appl. No.: 16/808,221

(22) Filed: Mar. 3, 2020

(65) Prior Publication Data

US 2021/0275864 A1 Sep. 9, 2021

(51) Int. Cl.

| | |
|---|---|
| ***A63B 22/06*** | (2006.01) |
| ***A63B 21/22*** | (2006.01) |
| ***A63B 22/00*** | (2006.01) |
| ***A63B 22/04*** | (2006.01) |

(52) U.S. Cl.

CPC ..... *A63B 22/0664* (2013.01); *A63B 21/225* (2013.01); *A63B 22/0023* (2013.01); *A63B 22/04* (2013.01); *A63B 2022/0676* (2013.01)

(58) Field of Classification Search

None

See application file for complete search history.

(56) References Cited

U.S. PATENT DOCUMENTS 5,957,814 A * 9/1999 Eschenbach ..... A63B 22/0664 482/57
5,997,445 A 12/1999 Maresh et al.
6,422,977 B1 * 7/2002 Eschenbach ..... A63B 22/001 482/52
7,060,005 B2 6/2006 Carlsen et al.
7,104,929 B1 * 9/2006 Eschenbach ..... A63B 22/0664 482/52
7,654,936 B2 * 2/2010 Liao ..... A63B 22/0015 482/52
7,722,505 B2 * 5/2010 Liao ..... A63B 22/0664 482/52
7,854,691 B2 * 12/2010 Long ..... A63B 22/001 482/52
7,946,962 B2 * 5/2011 Long ..... A63B 21/4035 482/52
10,532,246 B2 1/2020 Liao et al.
2006/0199702 A1 9/2006 Eschenbach
(Continued)

OTHER PUBLICATIONS

International Search Report and Written Opinion for PCT Appl. No. PCT/US2021/020556 dated Jun. 11, 2021.

*Primary Examiner* — Sundhara M Ganesan
*Assistant Examiner* — Shila Jalalzadeh Abyaneh
(74) *Attorney, Agent, or Firm* — Dorsey & Whitney LLP

(57) ABSTRACT

An exercise machine may be adjustable to vary a characteristic of the exercise provided by the machine, for example by changing the reciprocation path of movable components of the machine. In some examples, adjustment to an incline of the path of a reciprocating linkage may be achieved, for example by a lift assembly, the components of which may be arranged in a manner that provides a relatively compact form factor. In general, a more compact design may be achieved through the examples of the present disclosure, for example by co-axially locating a rotatable resistance element on the driven/input shaft.

32 Claims, 19 Drawing Sheets

(56) References Cited

U.S. PATENT DOCUMENTS

| | | | | |
|---|---|---|---|---|
| 2007/0072742 | A1* | 3/2007 | Chen | A63B 22/001 482/52 |
| 2008/0300114 | A1* | 12/2008 | Dalebout | A63B 22/0664 482/52 |
| 2012/0190507 | A1* | 7/2012 | Murray | A63B 22/001 482/52 |
| 2013/0199317 | A1* | 8/2013 | Law | F16H 19/08 74/47 |
| 2013/0237379 | A1* | 9/2013 | Huang | A63B 22/0664 482/52 |
| 2013/0310225 | A1* | 11/2013 | Johnson | A63B 22/203 482/52 |
| 2014/0121065 | A1* | 5/2014 | Dalebout | A63B 22/0017 482/52 |
| 2014/0206507 | A1* | 7/2014 | Murray | A63B 23/03583 482/52 |
| 2015/0087481 | A1* | 3/2015 | Liu | A63B 22/0015 482/52 |

* cited by examiner

ELLIPTICAL EXERCISE MACHINE

TECHNICAL FIELD

The present disclosure relates generally to physical fitness and personal training and more specifically to an exercise machine.

BACKGROUND

Various types of exercise machines exist to aid the user in performing physical exercise for example, for maintaining physical fitness. Elliptical machines, for example, have been developed to help a user perform cardiovascular exercise and/or strength training as part of a fitness program. Many existing elliptical machines are bulky (e.g., having a larger footprint) than other exercise machines that can aid the user with cardiovascular exercise, such as a stationary bicycle. Additionally, and despite being generally bulky, many existing elliptical machines are not sufficiently or easily adjustable to a particular user. Designers and manufacturers of elliptical exercise machines continue to seek improvements thereto.

SUMMARY

The present disclosure pertains to a stationary exercise machine, such as an elliptical exercise machine. The exercise machine is adjustable to vary an exercise characteristic of the exercise machine depending on user preference. For example, the exercise machine may be adjusted to a fit a particular user. In some embodiments, the exercise machine may be adjusted to vary the exercise movement provided to the user.

An exercise machine according to some embodiments includes a frame, a crank shaft rotatably coupled to the frame, and a reciprocating member supporting a pedal such that the pedal is constrained to move in a closed loop path. The reciprocating member is operatively coupled to the crank shaft such that movement of the pedal in the closed loop path causes rotation of the crank shaft. The exercise machine further includes a rail pivotally coupled to the frame and movably supporting the reciprocating member, the reciprocating member configured to translate along the rail when the pedal moves in the closed loop path, and a lift mechanism operatively coupled to the rail for adjusting an incline angle of the rail. The lift mechanism may include a lever link having a first end operatively coupled to the rail and an opposite second end operatively coupled to a linear actuator, the lever link being pivotally coupled to the frame at a location between the first and second ends of the lever link. In some embodiments, the first end of the reciprocating member is slidably supported on the rail and a second end of the reciprocating member is configured to rotate about the crank shaft when the pedals move along the closed loop path. In some embodiments, the reciprocating member is coupled to the crank shaft via a crank arm. In some embodiments, the frame includes a base for contact with a support surface and an upright support extending from the base. In some embodiments, the rail is pivotally coupled to the base and, optionally, the lever link is pivotally coupled to the upright support. In some embodiments, the linear actuator is coupled to the upright support at a location above a pivot point (or fulcrum) of the lever link. In some embodiments, the linear actuator is coupled to the frame at a location below a fulcrum of the lever link. In some embodiments, the linear actuator is coupled to frame such that an extension of the linear actuator increases the incline angle of the rail. In some embodiments, the exercise machine further includes a link arm coupling the first end of the lever link to the rail. In some embodiments, the exercise machine further includes a resistance mechanism operatively coupled to the crank shaft to resist rotation of the crank shaft. In some embodiments, the resistance mechanism includes a flywheel rotatably supported by the frame. In some embodiments, the flywheel is supported by the crank shaft. In some embodiments, the flywheel is supported on the crank shaft by one or more two-way bearings. In some embodiments, the crank shaft is operatively coupled to the flywheel to cause the flywheel to rotate responsive to but asynchronously with the crank shaft. In some embodiments, the pedal is pivotally coupled to the reciprocating member.

In some embodiments, the exercise machine includes a transmission assembly operatively coupled between the crank shaft and the flywheel to cause rotation of the flywheel at an output rotational speed greater than an input rotational speed to the transmission assembly. In some embodiments, the transmission assembly includes a two-stage belt-drive assembly. In some embodiments, the exercise machine includes a plurality of transmission members pivotally supported on the frame, wherein rotation of the crank shaft causes at least one of the transmission members to rotate synchronously with the crank shaft. In some such embodiments, the least one of the transmission members that rotates synchronously with the crank shaft is coaxially positioned to the flywheel. In some embodiments, the one or more of the transmission members are rotatably supported on a transmission shaft spaced apart from the crank shaft. In some embodiments, the lever arm is coupled to the frame at a location between the crank shaft and the transmission shaft.

In some embodiments, the exercise machine further includes a reciprocating handle link pivotally coupled to the frame and operatively associated with the crank shaft to drive rotation of the crank shaft. In some embodiments, the reciprocating handle link is coupled to the reciprocating member thereby operatively associating the handle link with the crank shaft. In some embodiments, the reciprocating handle link is coupled to the reciprocating member via a reciprocating foot link. In some embodiments, the reciprocating foot link is pivotally coupled to the reciprocating member at a location between a first end and a second end of the reciprocating foot link.

An exercise machine according to some embodiments includes a frame, a crank shaft rotatably supported on the frame, and a flywheel rotatable supported on the crank shaft and configured to rotate responsive to rotation of the crank shaft but at a different rotational speed than the crank shaft. The exercise machine further includes a reciprocating member supporting a pedal, the reciprocating member having a first end movably supported by the frame and constrained to move in a reciprocating back and forth motion responsive to movement of the pedal, and the reciprocating member having an opposite second end operatively coupled to the crank shaft to cause rotation of the crank shaft responsive to the reciprocating back and forth motion of the first end. In some embodiments, the exercise machine further includes a crank arm coupling the second end of the reciprocating member to the crank shaft. In some embodiments, the exercise machine further includes a handle link configured to be driven by a user's hand, and wherein the handle link is operatively coupled to the crank shaft for driving rotation of the crank shaft. In some embodiments, the exercise machine further includes a foot link pivotally coupled to the handle link and the reciprocating member. In some embodiments, the exercise machine further includes a rail pivotally coupled to the frame and movably supporting the reciprocating member, and a lift mechanism operatively engaged with the rail to vary an incline angle of the rail. In some embodiments, the frame includes a base for contact with a support surface and an upright support extending from the base. In some such embodiments, the exercise machine further includes a rail pivotally coupled to the base and slidably supporting the first end of the reciprocating member, and a lever link pivotally coupled to the upright support and operatively associated with the rail to pivot the rail relative to the base. In some embodiments, the exercise machine further includes a transmission assembly operatively coupled between the crank shaft and the flywheel to drive rotation of the flywheel at an output rotational speed greater than an input rotational speed to the transmission assembly. In some embodiments, the transmission assembly is a two-stage belt-drive assembly.

An exercise machine according to some embodiments includes a frame, a crank shaft rotatably coupled to the frame, a reciprocating member movably supported by the frame such that a first end of the reciprocating member rotates the crankshaft responsive to movement of the reciprocating member, a rail pivotally coupled to the frame and movably supporting a second end of the reciprocating member such that the second end of the reciprocating member translates along the rail when the first end rotates the crankshaft, and a lift mechanism that selectively adjusts an incline angle of the rail, the lift mechanism including a lever link having a first end operatively coupled to the rail and an second end coupled to a free end of an extendible rod, wherein the lever link is pivotally coupled to the frame at a fulcrum, and wherein a distance between the fulcrum and the first end is greater than a distance between the fulcrum and the second end such that movement of the free end of the extendible rod by a first travel distance causes the second end of the lever link to move a second travel distance greater than the first travel distance. In some embodiments, the lever link is pivotally coupled to an upright support of the frame. In some embodiments, the free end of the rod is oriented towards a base of the exercise machine such that extension of the rod causes an increase in the incline angle of the rail. In some embodiments, the free end of the rod is oriented away from a base of the exercise machine such that extension of the rod causes a decrease in the incline angle of the rail. In some embodiments, the exercise machine further includes a flywheel associated with a brake mechanism, wherein the flywheel is coupled to the frame at a location below the fulcrum. In some embodiments, the exercise machine further includes a transmission assembly that transmits the rotation of the crankshaft to the flywheel, wherein the transmission assembly includes at least one disk rotatably coupled to the frame at a location above the fulcrum. In some embodiments, the exercise machine further includes a pedal pivotally coupled to the reciprocating member such that the pedal is constrained to move in a closed loop path.

This summary is neither intended nor should it be construed as being representative of the full extent and scope of the present disclosure. The present disclosure is set forth in various levels of detail in this application and no limitation as to the scope of the claimed subject matter is intended by either the inclusion or non-inclusion of elements, components, or the like in this summary.

BRIEF DESCRIPTION OF THE DRAWINGS

The description will be, more fully understood with reference to the following figures in which components may not be drawn to scale, which are presented as various embodiments of the exercise machine described herein and should not be construed as a complete depiction of the scope of the exercise machine.

DETAILED DESCRIPTION

Figure 1:
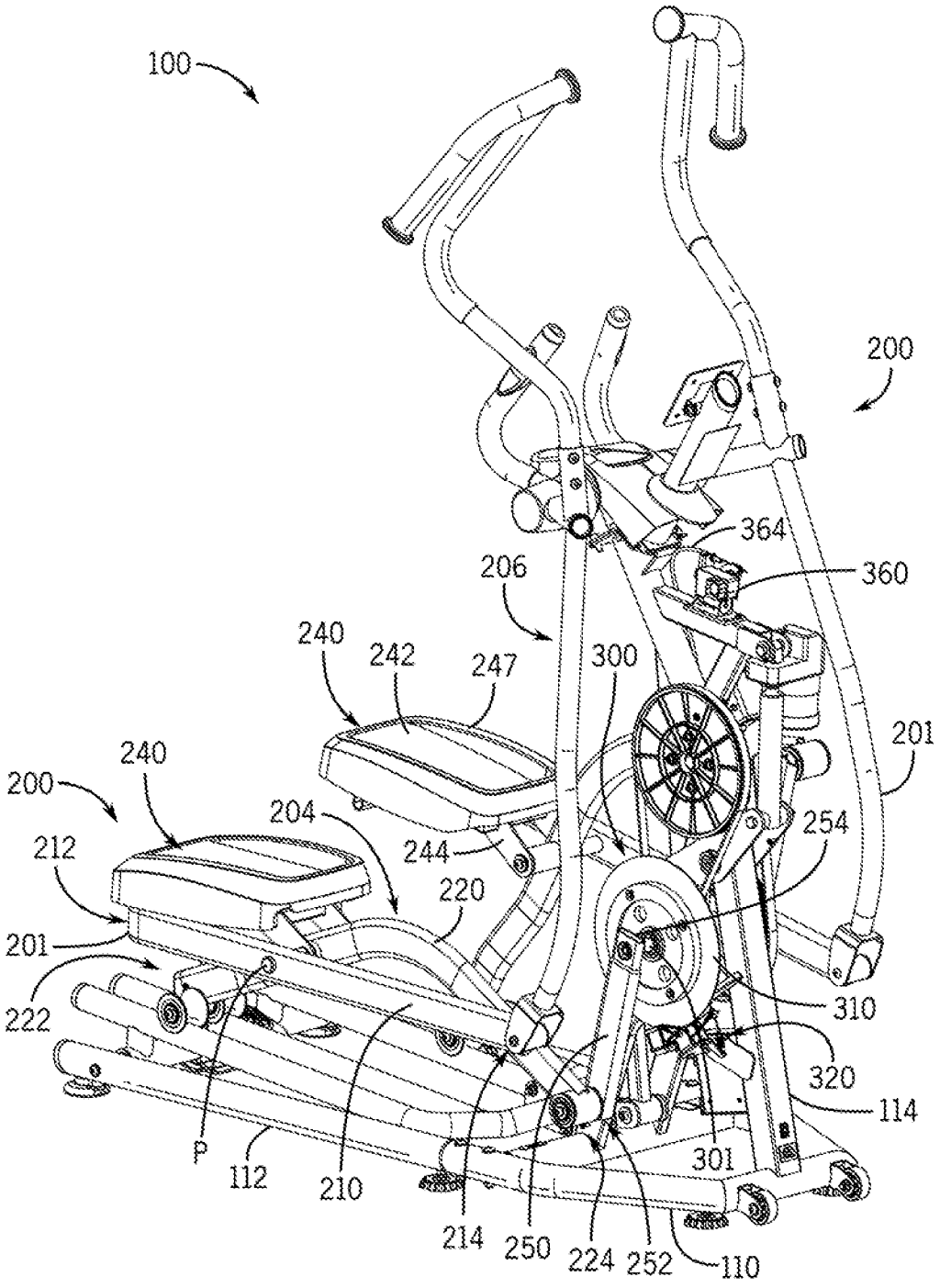
FIG. 1 is a front isometric view of a stationary exercise machine in accordance with some examples the present disclosure.

Embodiments according to the present disclosure include a stationary exercise machine, such as an elliptical machine, and components thereof. The stationary exercise machine according to the present disclosure may include components or assemblies that allow the machine to be more compact (e.g., occupy a smaller footprint) than existing exercise machines of a similar type, while, in some cases, providing adjustability (e.g., incline adjustments) comparable to or greater than existing exercise machines of the type. An exercise machine according to the present disclosure may include a frame, a crank shaft rotatably supported by the frame, and at least one reciprocating linkage configured for the application of a force by the user when using the machine and which transmits the movement or force of the user to the crank shaft. The reciprocating linkage may be operatively coupled to the crank shaft for driving the rotation of the crank shaft.

The reciprocating linkage may be supported by the frame in an adjustable manner. For example, the reciprocating linkage may be movably (e.g., slidably) supported on a rail, which is movably (e.g., pivotally) coupled to the frame to enable the user to vary the angle of the rail to the frame and/or ground, and consequently vary a characteristic of the exercise provided by the machine (e.g., a characteristic, such as an inclination of the closed loop path traversed by pedals of the machine). To that end, the exercise machine may include a lift mechanism operatively associated with the rail for varying the angle of inclination of the rail with respect to the frame and/or ground. By varying the angle of inclination of the rail, the user may be able to customize the exercise experience provide by the machine, for example to customize the machine for users of different sizes or stature and/or allow a user to selectively target or active different muscle groups. For example, in the case of an elliptical machine, the pedals of which traverse a substantially elliptical path, adjusting the incline of the rail may result in changing the angle of inclination of the elliptical path (e.g., an angle of inclination, with respect to the ground, of the major axis of the elliptical path). This may enable the user to customize the exercise experience between a more horizontal walking or running motion and a more vertical stair stepping motion. Alternatively or additionally, adjusting the incline of the rail may result in changing other characteristics of the elliptical path such as changing the eccentricity of the elliptical path and/or the length of an axis such as the major axis, which can be perceived by the user as a change in the length of the stride provided by the machine. An adjustment assembly (e.g., lift mechanism) that utilizes mechanical advantage can be implemented to provide comparable or greater range of adjustments, in some cases for an equivalent or smaller stroke of actuation, and in some case in a more compact form factor than existing exercise machines of the type. For example, a lift mechanism according to the present disclosure may include a lever link pivoted, at an intermediate location along its length, off the frame (e.g., an upward extending portion of the frame). One end of the lever link may be operatively engaged with an actuator (e.g., a linear actuator or an extendible or length-adjustable rod) for pivoting the lever link about its fulcrum, and the opposite end of the lever link may be operatively engaged with the rail for adjusting the incline angle of the rail. Such an arrangement, as compared to directly lifting the front of the rail to change its incline, may obtain a significant increase, in some cases two-fold or greater, in the incline adjustment range without a significant increase in power input (e.g., in some cases not exceeding 10%) or increase in the stroke of the linear actuator. A number of other advantages may be gained, such as reducing off-axis loading and torque on the linear actuator and reducing the form factor of the lift assembly, and the exercise machine altogether. In some embodiments, the distance between the fulcrum and the end coupled to the rail may be greater than a distance between the fulcrum and the end coupled to the actuator (e.g., the free end of an extendible rod) such that a given amount of extension by the actuator (e.g., a travel distance by the free end of the extendible rod) results in a larger amount of travel distance at the end coupled to the rail which may further enhance the mechanical advantage and/or other benefits or advantage that may be provided by the adjustment assembly.

FIGS. 1-20 illustrate and example of an exercise machine 100, shown here as an elliptical exercise machine, which includes a lift assembly or mechanism 400 for changing a characteristic (e.g., pedal path incline) of the exercise machine 100. The exercise machine 100 includes a frame 110 configured to support the exercise machine on a support surface (e.g., on the ground). The frame 110 includes a base 112 configured for contact with the support surface (e.g., the ground). The base 112 may lie substantially parallel to the ground (e.g., horizontally) when the machine is in use and may thus also be referred to as the horizontal frame portion 112. The frame 110 may further include one or more upright supports 114 extending from the base 112, which may also be referred to the upright frame portion 114. In the illustrated example, the upright frame portion 114 is arranged near the front of the horizontal frame portion 112, although other suitable arrangements may be used in other examples. In some examples herein, the frame 110 may be described as including the rigidly connected components of the machine 100 which supports, for example movable components of the machine, and may thus also be referred to as rigid frame 110.

The exercise machine 100 may include at least one, and typically a plurality of movable components supported by the frame 110. For example, the exercise machine 100 may include at least one, and typically a pair (i.e., a left and a right) reciprocating assemblies 200 that are driven by the user during exercise. The reciprocating assemblies may be operatively coupled to a crank shaft 301 to cause the crank shaft 301 to rotate when a reciprocating assembly 200 is driven by the user. The reciprocating assemblies 200 may include one or more (e.g., left and right) reciprocating linkages 201. The reciprocating linkages 201 may include components configured to support and/or be driven by a lower extremity of the user (e.g., the user's feet) and may thus be referred to as lower linkages 204. In some examples, the reciprocating linkages 201 may additionally or alternative include components configured to support and/or be driven by an upper extremity of the user (e.g., the user's hands) and may thus be referred to as upper linkages 206. In some examples, a lower linkage 204 may be connected to the respective upper linkage 206 such that movement of one of the two linkages (e.g., the upper linkage 206 or the lower linkage 204), for example when driven by the user, causes the other one of the two linkages (e.g., the lower linkage 204 or the upper linkage 206) to move.

Figure 2:
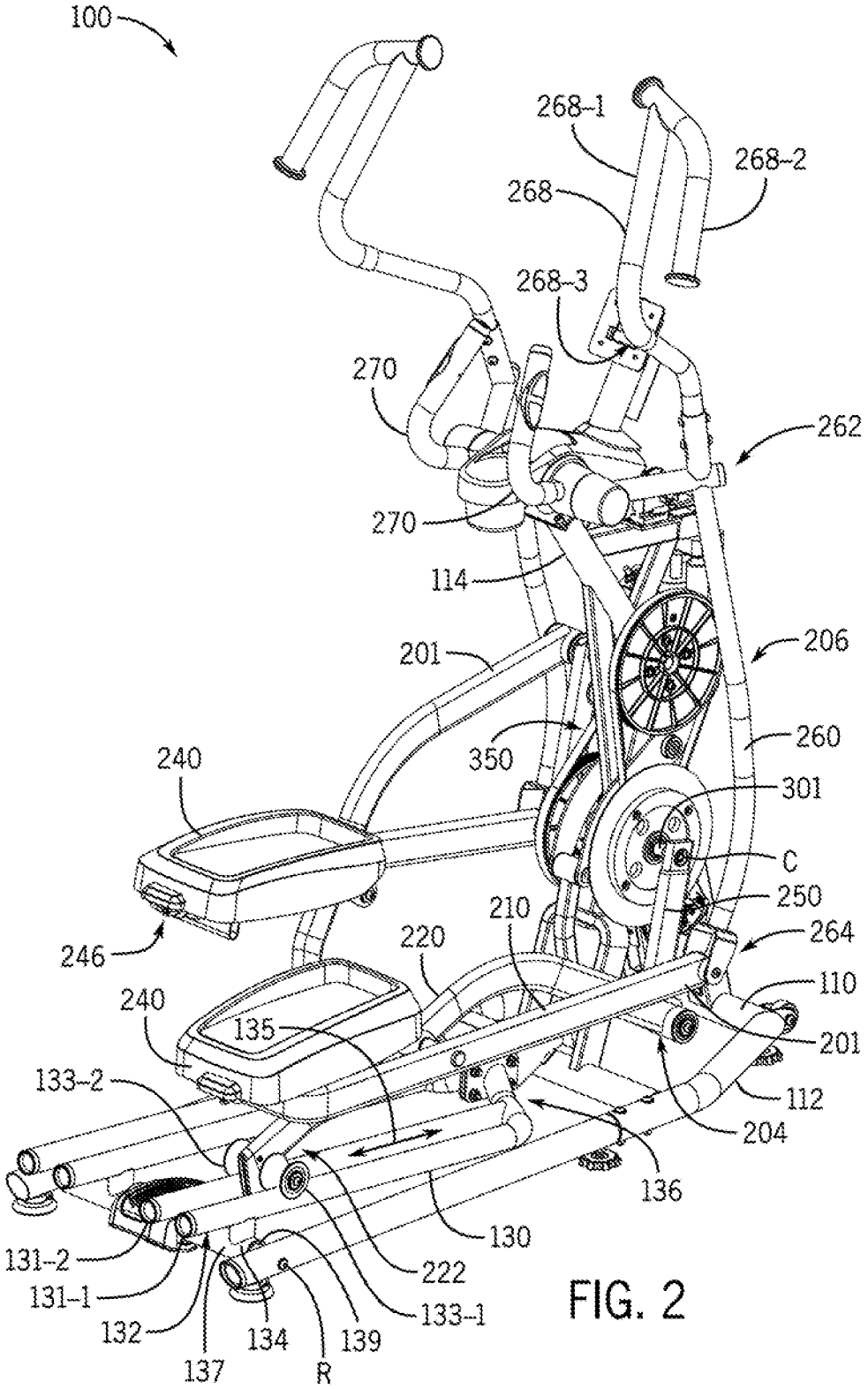
FIG. 2 is a rear isometric view of the exercise machine in FIG. 1.

Referring to FIGS. 1-2, the exercise machine 100 includes left and right reciprocating lower linkages 204, each of which includes a reciprocating member 220 that supports a pedal assembly (or simply pedal) 240. The reciprocating member 220 has a first or proximal end 222 and a second or distal end 224 opposite the first end 222. The reciprocating member 220 may be implemented using an elongate substantially rigid structure, such as a bar, which in this case has at least one curved portion between the two ends 222 and 224 of the reciprocating member 220. In other examples, the reciprocating member 220 may be substantially straight or have a different suitable geometry. The term proximal is used herein to refer to components or ends thereof which are relatively closer to the user, during use of the machine, such as the end closer to where user force is applied, while the term distal is used herein to refer to components or ends thereof relatively farther from the user during normal use of the machine, The distal end 224 of the reciprocating member 220 is operatively coupled to a crank shaft 301, in this example via a crank arm 250. A first end 252 of the crank arm 250 is pivotatlly coupled to the distal end 224 and the opposite, second end 254 of the crank arm 250 is rigidly coupled to the crank shaft 301 such that the crank arm 301 rotates synchronously with the crank shaft 301. While the crank arm 250 is illustrated here as a generally straight rigid link or bar of a given length, the crank arm 250 may be provided by any rigid body, such as a radially-extending portion of a disk or other, which operatively connects the distal end 224 of the reciprocating member 220 to the crank shaft 301, providing a load path for transmitting the force from the reciprocating member 220 to the crank shaft 301. The crank shaft 301 may be coupled to a resistance mechanism 300 such that rotation of the crank shaft 301 about its axis (i.e., crank axis C) is resisted by the resistance mechanism 300, e.g., as described further below.

As previously described, in some examples, the lower linkage 204 may be operatively connected with a reciprocating upper linkage 206 configured to support and/or be driven by a hand of the user. In the present example, the upper linkage 206 is coupled to the lower linkage 204 via a foot link 210. The foot link 210 may be implemented as an elongate rigid member, in some case a substantially straight bar, which has a first or proximal end 212, a second distal end 214 opposite the first end 212, and a length defined therebetween. The foot link 210 may be coupled at its distal end 214 to the upper linkage 206. The foot link 210 may be coupled to the reciprocating member 220 at or near the proximal end 212 or any suitable location between the proximal and distal ends 212, 214, respectively, of the foot link 210. The foot link 210 may be pivotally coupled to the reciprocating member 220 at a pivot joint 216 such that reciprocating member 220 and the foot link 210 can both pivot relative to one another and about the pivot axis P. In some embodiments, the foot link 210 may also be coupled to the pedal 240 and may support the pedal 240 at one or multiple locations. In some embodiments, the foot link 210 may extend distally of its connection with the reciprocating member 220, e.g., to support the pedal assembly 240 and/or components associated therewith. In the present example, the pedal 240 is pivotally coupled to the foot link 210 such that it is pivotable relative to the foot link 210 and the reciprocating member 220 about the same pivot axis P, and a rear portion of the pedal 240 is supported at the distal end of the foot link 210.

In some examples, the reciprocating member 220 (e.g., its proximal end 222) may be movably, in this case slidably, supported on the frame 110. For example, as shown in FIG. 2, the proximal end 222 is configured to slide on one or more rollers (e.g., rollers 133-1 and 133-2) along a rail 130. The rail 130 may be implemented using any suitable structure to define a path 135, which may be linear as in the present example or curved in other examples, such that, in use, the proximal end 222 of the reciprocating member 220 is constrained to travel (e.g., reciprocate) along the path 135. For example, the rail 130 may be implemented using a pair of substantially parallel rail members, shown here as tubes 131-1 and 131-2, each slidably or rollably supporting a respective one of the pair of rollers 133-1 and 133-2. In other examples, a single or a greater number of rail members may be used than in specific example here. In yet other examples, the rail 130 may take on a different shape or configuration, such as by being configured to engage differently shaped rollers or engage different portions of the rollers. In yet other examples, the reciprocating member 220 (e.g., its proximal end 222) may be movably supported on a rail in an entirely different manner that constrains the proximal end 222 in a reciprocating motion along a predefined path.

The rail 130 may be movably (e.g., pivotally) coupled to the frame to allow the relative position (e.g., incline) of the rail 130 to be changed. For example, the rail 130 may be pivotally coupled to the frame 110, and more specifically to the base 112, via any suitable pivot joint, referred to herein as rail pivot 134, that constrains all degrees of freedom except for one rotational degree of freedom of the rail 130. As shown in FIG. 2 and also in FIG. 15, the rail 130 may include a base, shown here as a transverse tube 137, rigidly coupled to the rail 130, for example at a location near its rear or proximal end 132. The tube 137 may be rotatably received over a rod 139, such that the tube 137 and consequently the rail 130 can pivot about a rail pivot axis R in response to a moment about the axis R, e.g., as may be applied by the lift mechanism 400 and as described further below.

The exercise machine 100 may include a pedal assembly (or simply pedal) 240 associated with each of the lower linkages 204. The pedal assembly 240 may be supported by the reciprocating member 220, the foot link 210, or both. The pedal assembly 240 may include a footplate 242, which in use supports the user's foot. The footplate 242 may be fixed to (e.g., rigidly attached or integrally formed) with a pedal shroud 247, which may include one or more walls extending from the footplate 242 to restrict movement of the user's foot in one or more direction (e.g., the forward and lateral directions). The footplate 242 may be coupled to the supporting structure (e.g., the reciprocating member 220 and/or the foot link 210) via a pedal mount 244. In some examples, the pedal 240 may be pivotally coupled to its supporting structure (e.g., the reciprocating member 220 and/or the foot link 210). In such examples, the pedal mount 244 may include a pivot joint that restricts all degrees of freedom except for one rotational degree of freedom to allow pivotal movement of the pedal 240 about the pedal pivot axis P. Such arrangement may enable pivotal movement of the pedal 240 during use of the machine 100 and/or pivotal adjustment to the pedal 240 prior to use, for example to change the incline of the pedal 240, such as from a neutral or relatively flat position to a heels-up position or other. In some such examples, the pedal assembly 240 may be associated with a pedal adjustment mechanism 246 that enables the user to change the angle of the pedal with respect to the supporting structure (e.g., the reciprocating member 220, the foot link 210, or both). For example, as shown e.g., in FIGS. 15 and 17, the pedal adjustment mechanism 246 may include a pop-pin 249 configured to engage any of a plurality of slots, notches or other suitable detents on the supporting structure, each of which positions the footplate 242 at a different angle with respect to the supporting structure. In some examples, the pedal adjustment mechanism 246 may be configured to enable the pedal 240 to resiliently support the user's foot during use of the exercise machine. The pedal assembly 240 of exercise machine 100 may be implemented in accordance with any of the examples in U.S. Ser. No. 14/986,068, titled "Pedal Assembly for Exercise Machine," which is incorporated herein by reference.

The exercise machine 100 may also include an upper reciprocating linkage 206 configured to be driven by a user's hand. The upper reciprocating linkage 206 may be operatively associated with the crank shaft 301 for transferring the force applied by the user to the crank shaft 301. In some embodiments, the upper reciprocating linkage 206 may be operatively coupled to the crank shaft 301 solely via its connection to the lower reciprocating linkage 204. As shown e.g., in FIGS. 2 and 3, the upper linkage 206 may include a handle link 260 terminating at a handle 268 configured to be gripped by the user. The handle link 260 may be pivotally coupled, near its proximal end 262, to the frame 110, and more specifically to the upright frame portion 114. The handle link 260 may be coupled to the frame at pivot location 261 such that, in use, the handle link 260 reciprocally pivots about a handle pivot axis H. The proximal end 262 of the handle link 260 may be fixed to (e.g., rigidly connected or integrally formed with) the handle 268 such that the handle 268 reciprocates in synchrony with the reciprocal movement of the handle link 260. In some examples, the handle 268 may include different distinct grip locations 268-1, 268-2, 268-3, e.g., to accommodate users of different builds (e.g., slimmer or, wider users) and/or activate different muscle groups of the user. The exercise machine 100 may optionally include additional handles 270, which may be fixed to the frame 110 and thus may also be referred to as fixed handles 270.

The distal end 264 of the handle link 260 may operatively associated with the crank shaft 301, in this example indirectly, via the connection between the upper linkage 206 to the lower linkage 204, which may be directly connected to the crank shaft 301. In other examples, the upper linkage 206 may be differently connected to the crank shaft 301 such as via a direct connection between the upper linkage 206 and the crank shaft 301. As shown e.g., in FIG. 2, the distal end 264 of the handle link 260 may be pivotally connected to the distal end 214 of the foot link 210 by any suitable pivot joint, such as a lug and clevis joint. As illustrated in FIGS. 3-6, in use, as the pedal 240 traverses the path E, shown here as being substantially elliptical, the foot link 210 reciprocate back and forth and consequently the distal end 264 of the handle link 260 reciprocates in corresponding back and forth motion. The reciprocating linkages 201 may be configured such that when a given pedal (e.g., the right pedal) is moved to the forward most position along its elliptical path, the corresponding handle (e.g., the right handle) is in a position closest to the user, while the opposite handle (e.g., the left handle) is in a position farthest from the user and the opposite pedal (e.g., the left pedal) is in the aft most position along its elliptical path to mimic natural walking or striding motion where each arm swings with the motion of the opposing leg.

Figure 3:
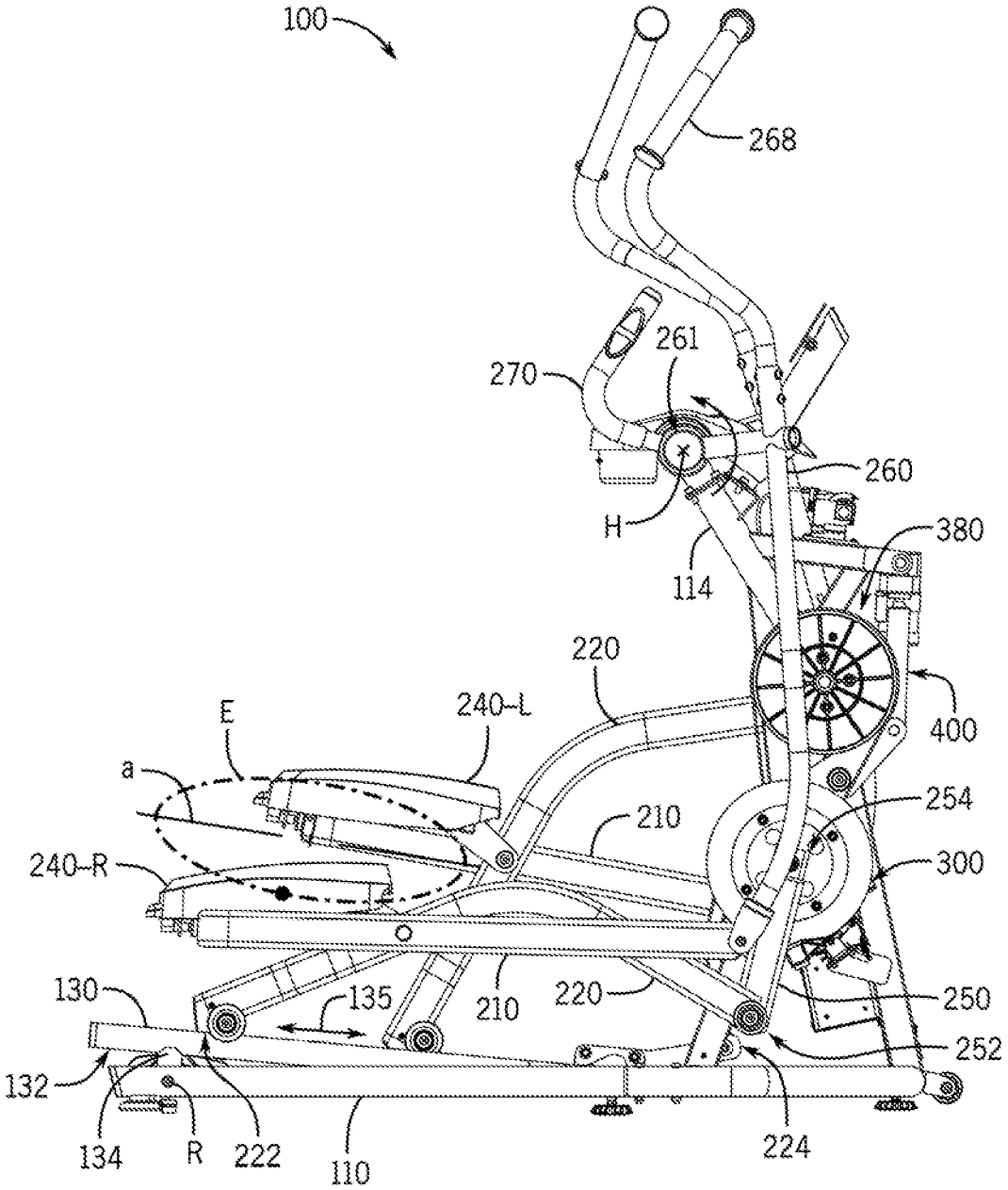
FIG. 3 is a side view of the exercise machine in FIG. 1.
Figure 4:
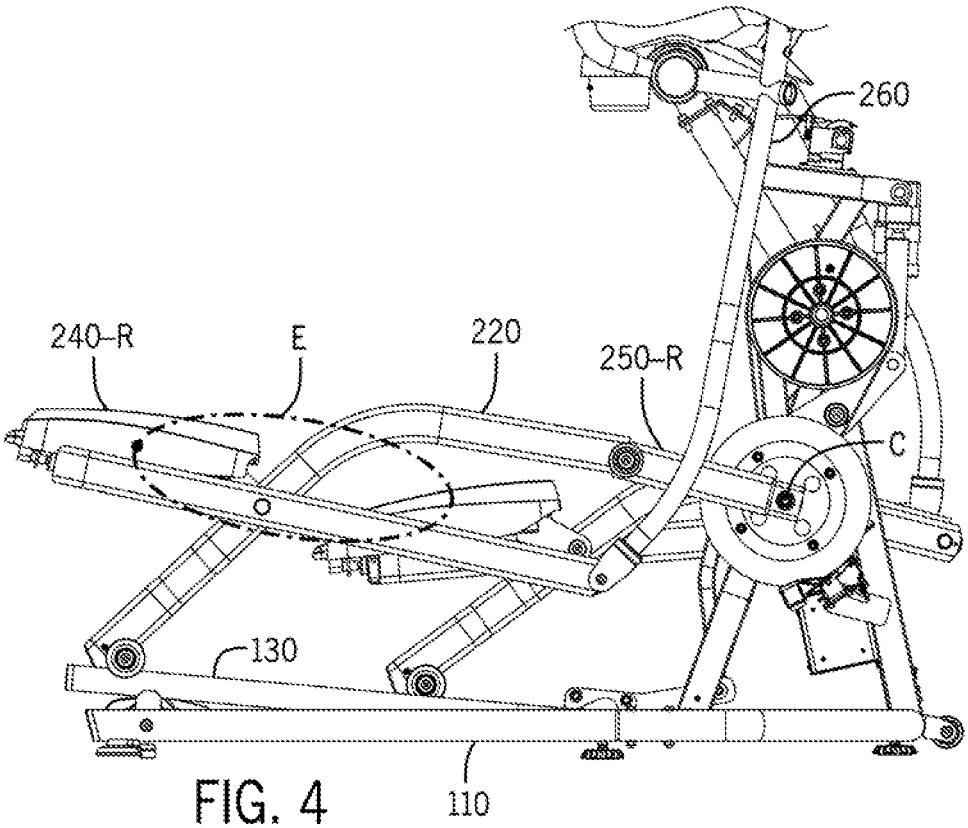
FIG. 4-6 are additional side views of a portion of the exercise machine in FIG. 3 with the pedals in different locations along the closed loop path.
Figure 5:
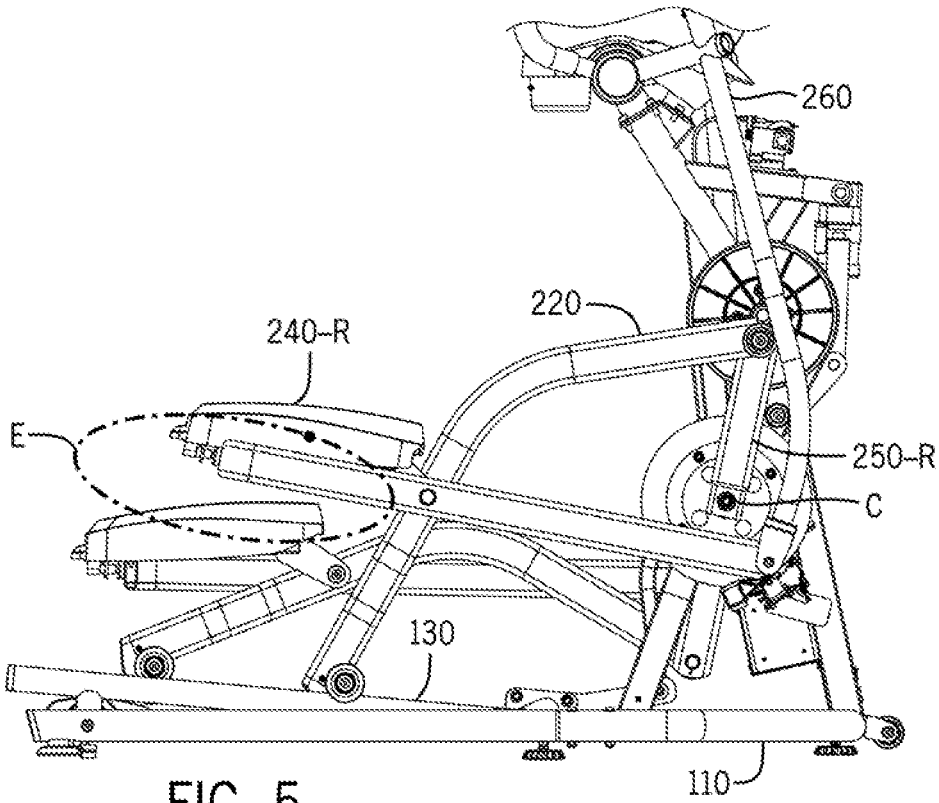
Figure 8:
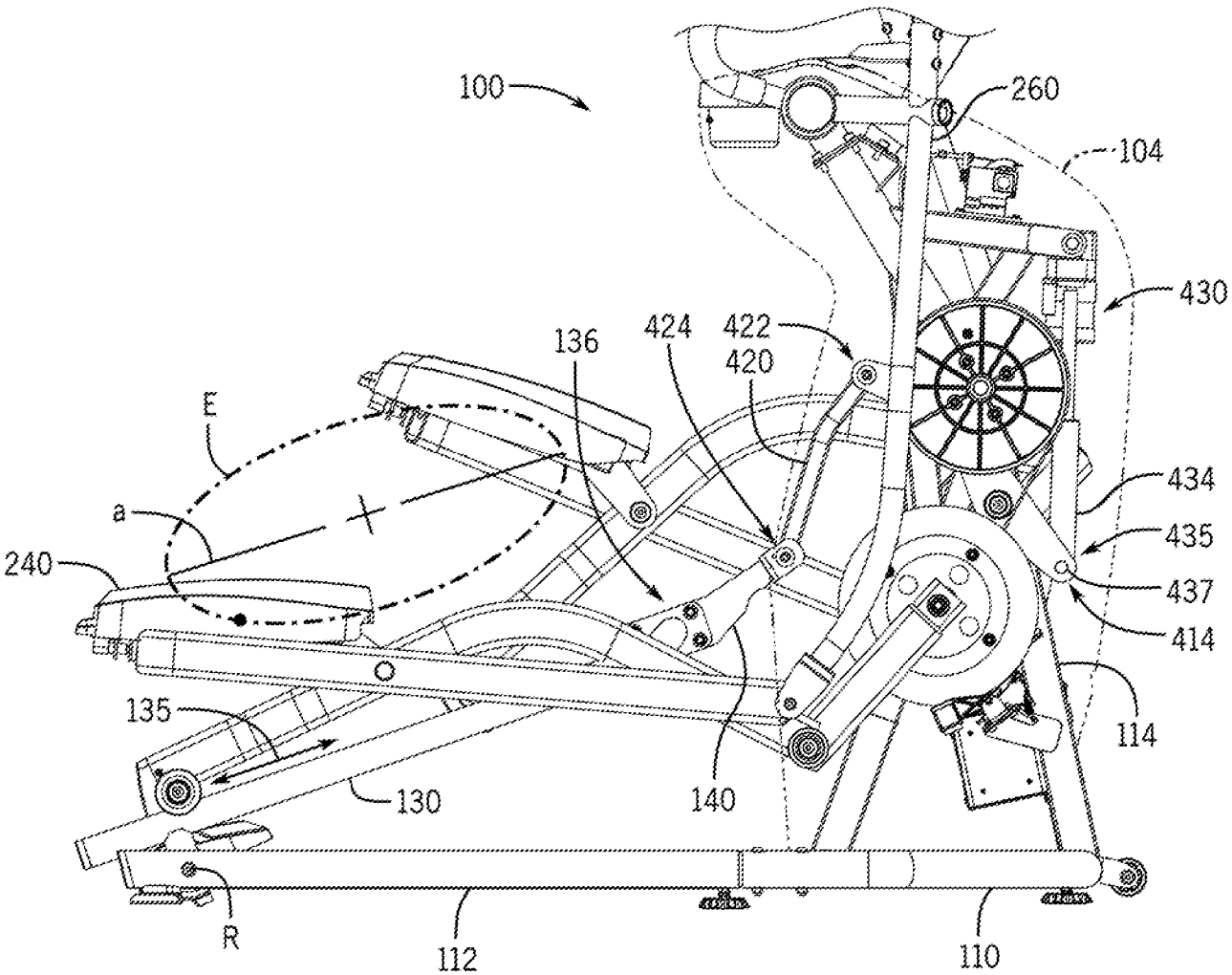
FIG. 8 is yet another side view of the portion of the exercise machine in FIGS. 3 and 7 show here with the lift mechanism further adjusted to further increase the incline as compared to FIGS. 3 and 7.

FIGS. 3-6 illustrate the exercise machine 100 at four positions of the pedal 240 along the closed loop, here elliptical, path E. The exercise machine 100 may be configured to enable the pedal 240 to traverse the elliptical path E in a clockwise direction to mimic natural forward walking or striding. The exercise machine 100 may be configured to additionally or alternatively enable the pedal 240 to traverse the elliptical path E in the reverse, counterclockwise direction, such as to allow the user to engage different muscle groups. In the clockwise direction that mimics natural bipedal walking/running, the upper portion of the elliptical path E (also referred to here as ellipse E) generally corresponds to the swing phase of the stride, while the lower portion of the ellipse E generally corresponds to the stance phase (or contact phase) of the stride. As shown in FIG. 3, for example, the right pedal 240-R may be near the bottom of the elliptical path E, which generally corresponds to near the mid stance of the stride or gait cycle. In this position of the pedal, the corresponding right crank arm 250-R may be near the 6 o'clock position or extending generally downward toward the ground. As the user continues to move the foot through a forward gait cycle and consequently drives the pedal 240-R in a clockwise direction along the path E, the pedal 240-R moves to a position near the rear end of the elliptical path E, as shown in FIG. 4, which may generally correspond to the toe off (or pre-swing) portion of the stance phase. In this position of the pedal 240-R, the corresponding crank arm 250-R may be near the 9 o'clock position, extending rearward, nearly horizontally. In some examples, the rail 130 may be configured to support the lower linkage 204 in a manner that results in a negatively inclined elliptical path E, as shown in FIGS. 3-6, and may be adjustable from this nominal position to a maximum incline position as shown in FIG.8), in which the elliptical path E is positively inclined.

Figure 6:
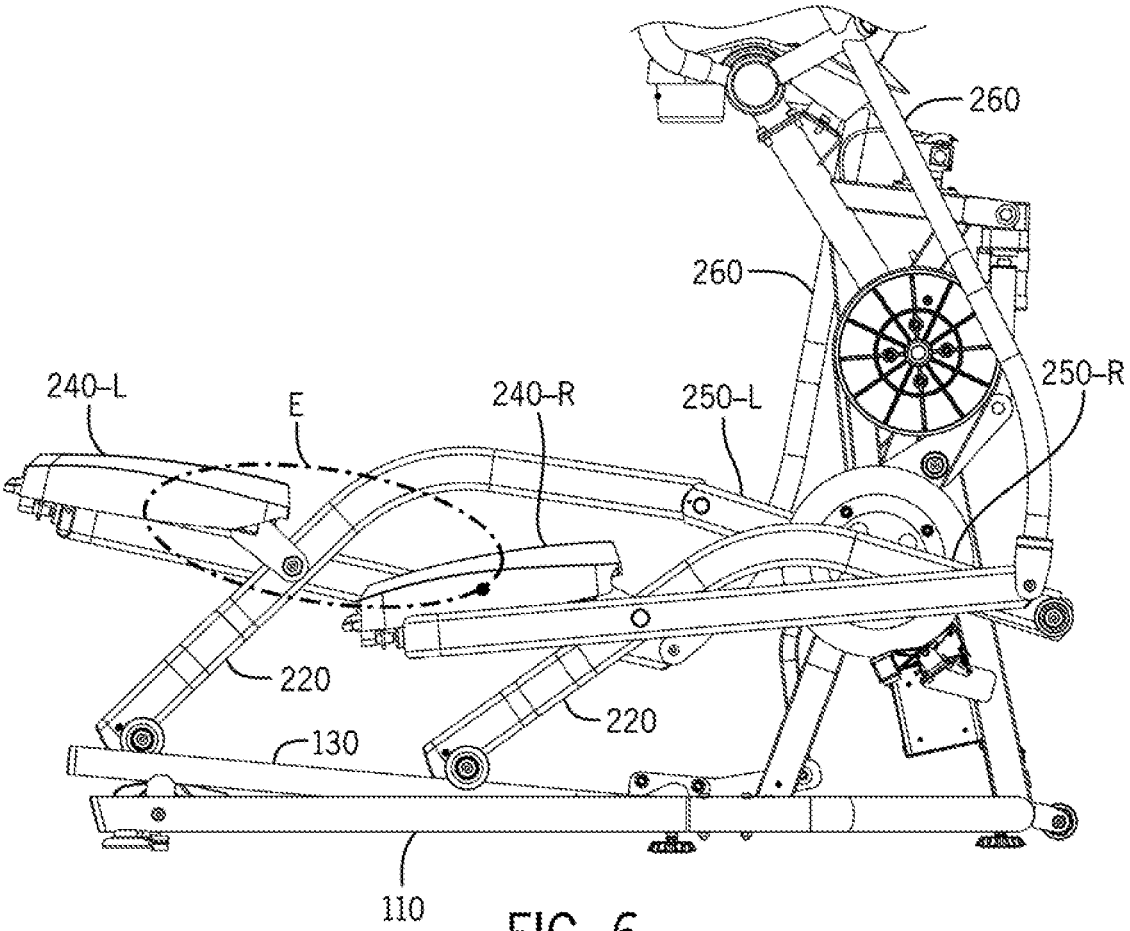

Returning back to FIGS. 3-6, as the user continues to move the foot through the gait cycle, advancing the pedal 240-R further along the elliptical path E, the pedal may move from the rear-most position of FIG. 4 to a position near the top of the elliptical path E, which may generally correspond to the mid swing phase of the gait cycle, and in which position the corresponding crank arm 250-R may be near the 12 o'clock position, extending upward, near vertically. As the user continues to advance the foot through the cycle to complete a full stride cycle, the pedal 240-R may pass through the forward most position along the elliptical path E, as shown in FIG. 6, which may generally correspond to the terminal swing phase of the gait cycle. In this position, the corresponding crank arm 250-R may be near the 3 o'clock position or extending forward, nearly horizontally. It will be understood that the driven components on the opposite (e.g., left) side of the exercise machine 100 may traverse similar paths but in opposition to the right side, such that, for example, when the right crank arm 250-R extends forward the left crank arm 250-L extends in radially opposite direction or rearward, as shown in FIG. 6. Similarly, while the right pedal 240-R is at the forward most position along its elliptical path E, the left pedal 240-L is at the rear most position along its elliptical path.

Figure 7:
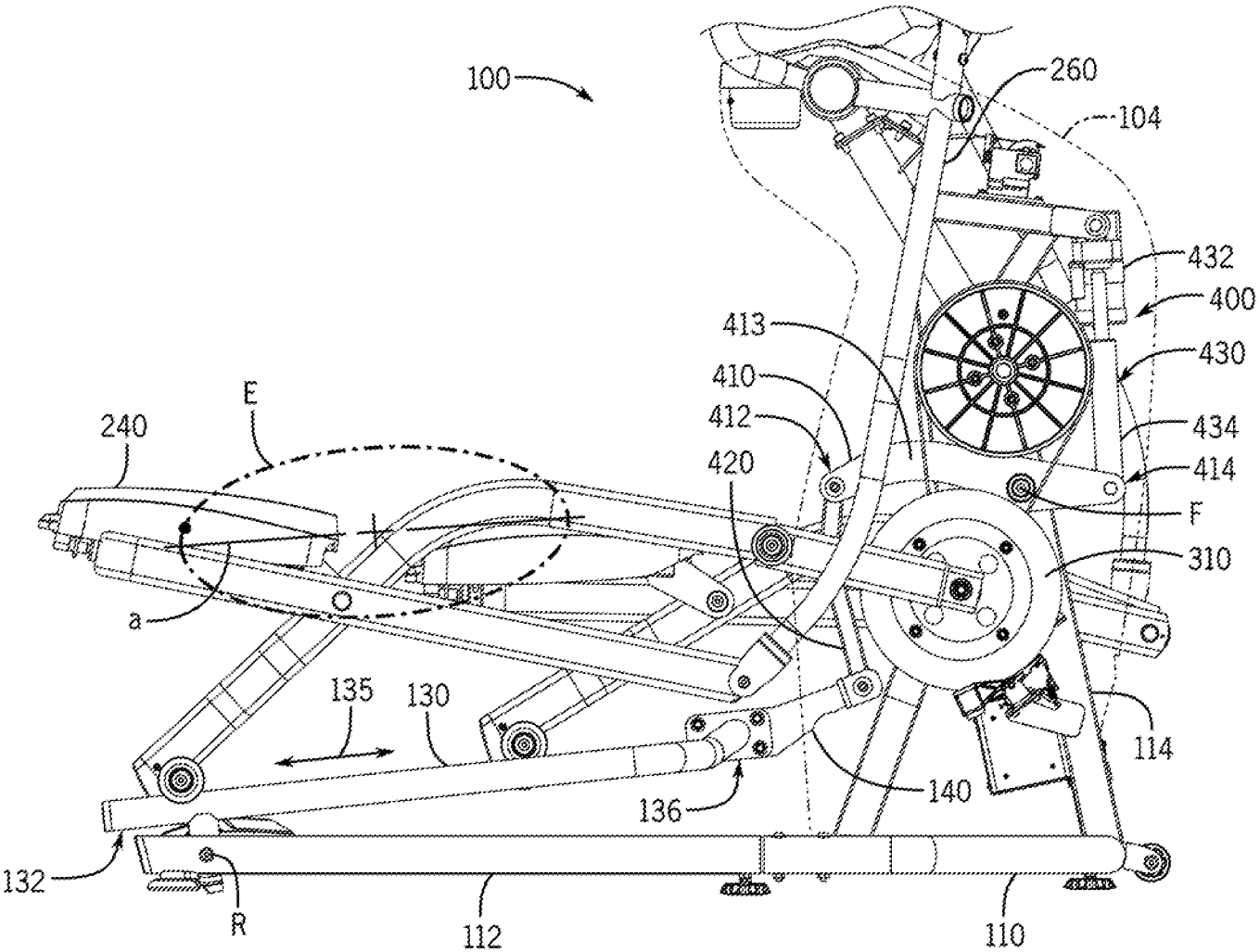
FIG. 7 is a side view of the portion of the exercise machine in FIG. 3 show here with the lift mechanism adjusted to provide a different incline.

In accordance with the present disclosure, the pedals 240 may be supported on the frame 110 of the exercise machine in a manner which enables the user to vary a characteristic of the exercise provided by the machine 100, such as by varying a characteristic of the closed loop path E traversed by the pedals. Referring back to FIGS. 2 and 3 and now also to FIGS. 7 and 8, the rail 130 which supports the lower linkage 204 may be pivotable to vary its incline angle. The rail 130 may be adjustable between a nominal (or minimum incline) position, which in the present example is at a negative incline with respect to the horizontal frame portion 112 and the ground (see FIG. 3), and a maximum incline position, e.g., as shown in FIG. 8. In some examples a range of up to about 20 degrees of incline adjustment may be achieved, and in some cases greater than 20 degrees, such as, up to 30 degrees or more. As can be observed from FIGS. 3, 7 and 8, which show the exercise machine 100 at three incline positions including the nominal, an intermediate, and the maximum incline positions, respectively, as a result of adjusting the incline of the rail 130, a characteristic of the elliptical path E, for example the angle of inclination of the major axis a, may be varied. As shown in FIG. 3, the elliptical path E may be nearly horizontal or slightly negatively inclined at the nominal incline position of the rail 130, which may mimic a more horizontal walking or running motion. As the incline of the rail 130 is increased, the angle of inclination of the major axis a may also increase, as shown in FIGS. 7 and 8, to mimic increasingly more vertical motion, such as a stair climbing motion as the inclination approaches the maximum. To effect such incline adjustments, the exercise machine 100 may include a lift mechanism 400 operatively associated with the rail 130 to pivot the rail 130 about its pivot axis R In some examples, the lift mechanism 400 may include a lever link 410, a link arm 420, and a length-adjustable link, shown here as linear actuator 430. The lever link 410 may be implemented using a rigid member (e.g., bar) having a first of proximal end 412 and a second or distal end 414. The lever link 410 may be pivotally coupled to the frame 110, more specifically to the upright portion of the frame 114, at a location between the first and second ends 412, 414, respectively, of the lever link 410, which defines the pivot location or fulcrum F of the lever link 410. The link arm 420 may couple the first end 412 of the lever link 410 to the rail 130, and the length-adjustable link (e.g., linear actuator 430)

may couple the opposite, second end 414 of the lever link 410 to the frame 110. The linear actuator 430 may be any suitable linear actuator including a combination of a motor 432 operably arranged to extend a rod 434. The motor 432 can be any suitable motor, such as an electric rotary motor. The rod 434 may be implemented using any suitable telescoping member, which is in operative arrangement with the motor 432 to convert, e.g., a rotary input of the motor 432 to linear output at (e.g., extension and retraction of) the free end of the rod 434. The linear actuator 430 may utilize electromechanical, hydraulic, or pneumatic actuation, or any combination thereof. For example, instead of an electrically driven rod-type actuator, the actuation may be provided by a hydraulic, pneumatic, electro-hydraulic or electro-pneumatic cylinder.

Figure 9:
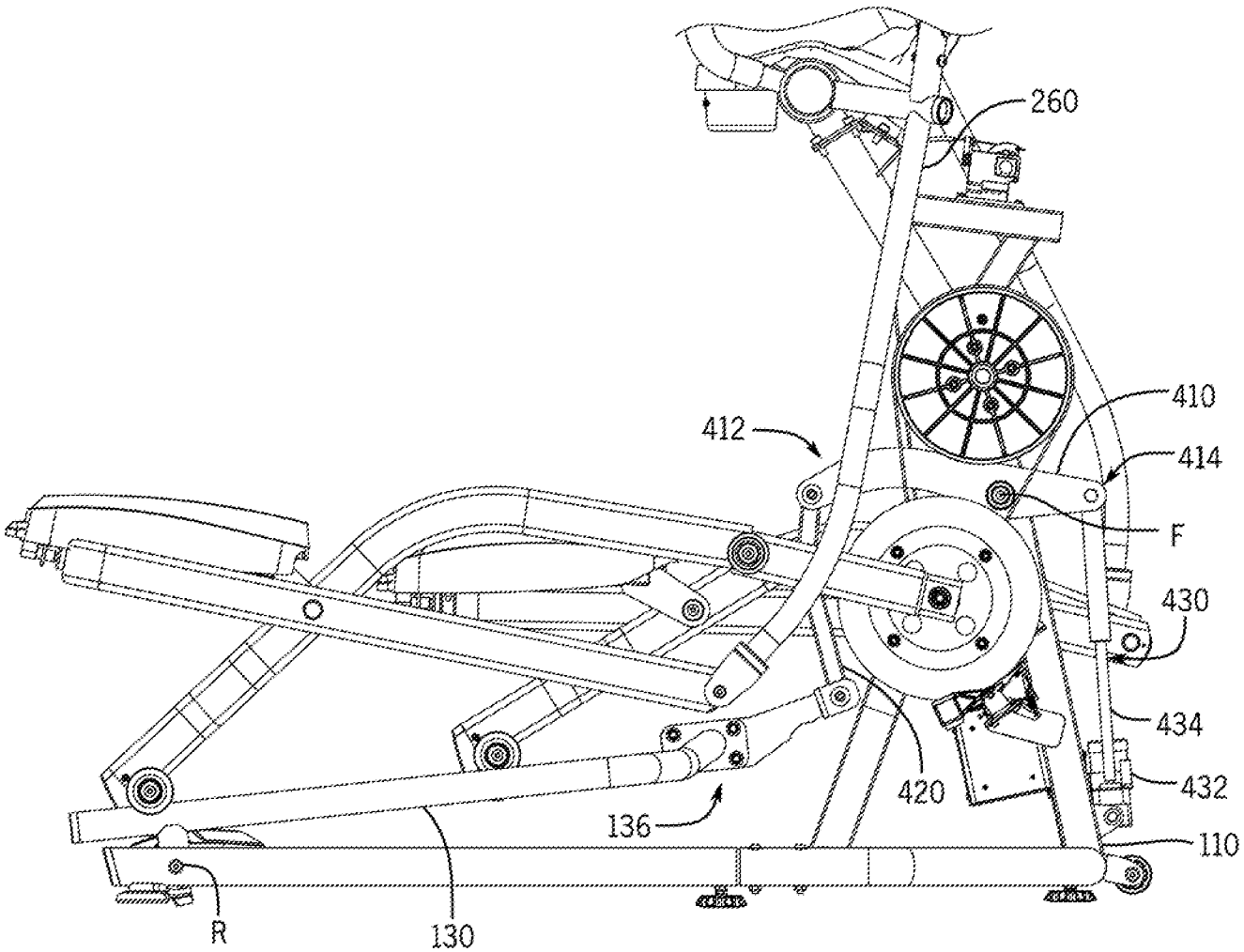
FIG. 9 is a side view of a portion of an exercise machine similar to that shown in FIG. 7 with the lift adjustment mechanism in a different configuration.

In some examples, the actuator 430 may be coupled to the frame 110 at, a location above the fulcrum F such that extension of the linear actuator 430 applies a force (against gravity) to lift the front end 136 of the rail 130 and thus increase the incline of the rail 130, as shown in FIGS. 7 and 8. In other examples, as shown in FIG. 9, the actuator 430 may be coupled to the frame 110 at a location below the fulcrum F such that the extension of the actuator 430 cooperates with gravity to lower the rail 130, while lifting of the rail 130 is achieved through retraction of the linear actuator 430. While the operation of the lift mechanism is described here with reference to a linear actuator, it will be understood that the lift mechanism may employ any number, including a plurality, of actuators, operating in concert (e.g., two or more actuators concurrently extending or retracting to lift or lower the rail), in opposition, or in other suitable configuration.

Figure 10:
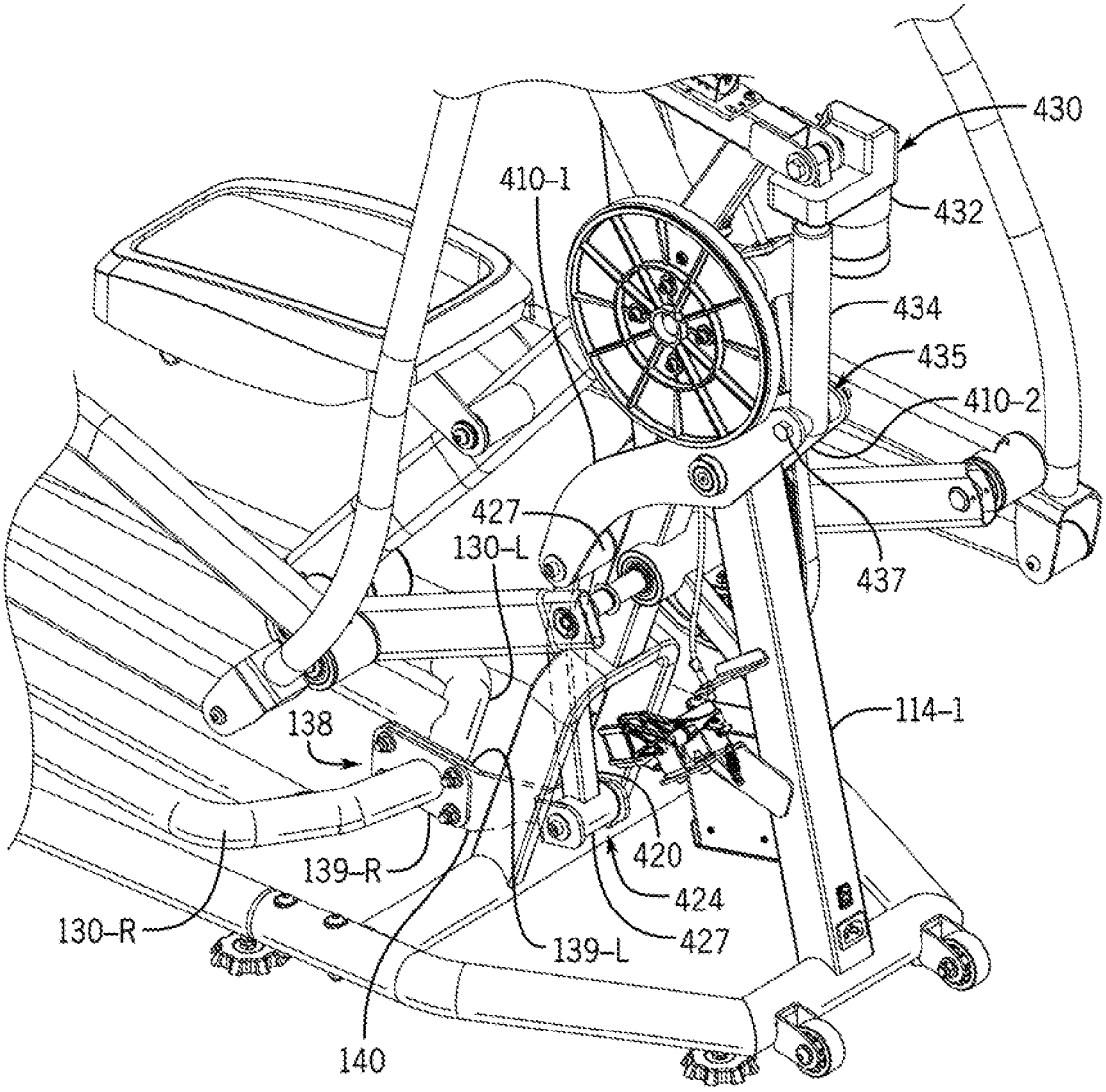
FIG. 10 is an enlarged partial view of a front portion of the exercise machine in FIG. 1 showing components of the lift adjustment mechanism.

Referring now also to FIG. 10, the lever link 410 may be implemented using a single or multiple rigid members, in this case a pair of rigid bars 410-1 and 410-2 coupled to opposite sides of an upright support 114-1 of the frame 110. Each of the bars 410-1 and 410-2 may have complementary shape and each may be pivoted off the upright support 114-1 such that both of the bars 410-1 and 410-2 pivot about a common axis passing through the fulcrum F, such that the two bars function in concert as a single link. The lever link 410 may be a straight rigid member. In some examples, at least a portion of the lever link 410 may be contoured (e.g., curved), which may improve its load bearing performance. For example, the proximal portion 413 of the lever link 410 extending between the fulcrum F and the proximal end 412 may be curved with the concave side facing down, which may reduce stress concentrations and/or more efficiently distribute the internal loads in the proximal portion 411 due to beam-bending when the rail 130 is lifted off the ground. The lever link 410, the link arm 420, or portions thereof, may additionally or alternatively be contoured (e.g., curved) for other considerations such as to fit within a desired form factor (e.g., within the shroud 104) of the exercise machine 100. In some embodiments, the lever link 410 may be coupled to the frame such that the distance between the pivot point (or fulcrum F) and the distal end 414 of the lever link 410 which is coupled to the actuator is smaller than the distance between the pivot point (or fulcrum F) and the opposite proximal end 412 of the lever link 410, whereby a smaller distance of travel of the distal end 414 may cause a greater amount of travel at its proximal end 412 enhancing the mechanical advantage of the system.

The lever link 410 may be pivotally coupled, at its distal end 414, to the free end 435 of the rod 434 of the actuator 430 using any suitable pivot joint, such as a lug and clevis joint. In this example, the distal ends of the bars 410-1 and 410-2 act as the opposite sides of the clevis, while the free end 435 of the rod 434 acts as the lug, with a pin 437 pivotally connecting the two. In other examples, a different arrangement may be used such by reversing the location of the lug and clevis or using a different suitable pivot joint. The lever link 410 may be pivotally coupled to the link arm 420, e.g., similarly using a lug and clevis joint, with the lever link 410 again providing the clevis part of the joint. In other words, the proximal ends of the bars 410-1 and 410-2 may act as the opposite sides of the clevis, while the cooperating end of the link arm 420 may provide the lug of the pivot joint.

As shown e.g., FIG. 10, the link arm 420 may be implemented as a rigid member, e.g., a solid or tubular bar of any suitable cross-section including but not limited to square, rectangular or circular cross-sections. A respective tube 427 may be transversely positioned at each end of the opposite ends 422 and 424 of the link arm 420 to provide a lug end for the respective lug and clevis joints with the lever arm 410 and the rail 130, respectively. The rail 130, which in this example includes a right rail 130-R and a left rail 130-L, is coupled at its distal end 136 to the link arm 420 via a bracket 140, which terminates with a clevis 142. The right rail 130-R is fixed to one side of the bracket and the left rail 130-L is fixed to another side of the bracket, joining the right rail 130-R and the left rail 130-L together at the front end 136 of the rail 130. The right rail 130-R and the left rail 130-L may be fixed together and to the bracket 140, using any suitable means for rigidly coupling such as welding or bolting respective flanges 139-R and 139-L of the rail to the bracket 148, or by being integrally formed with the bracket 140. The bracket 140 may extend at the front end 136 of the rail 130 and may be used to operatively (e.g., pivotally) couple the front end 136 of the rail 130 to the lift mechanism 400. It will be appreciated, that the specific arrangement and coupling of components described is provided for illustration only and other suitable combinations or arrangements may be used in other examples.

As previously described, the crank shaft 301 may be operatively associated with a resistance mechanism 300 to resist the rotation of the crank shaft 301. In some examples, the crank shaft 301 may be associated with a rotatable resistance mechanism such as a magnetically-resisted flywheel 310. In other examples, the flywheel 310 may be frictionally resisted or employ another suitable type of resistance mechanism that can resist, in some cases selectively variably, the rotation of the flywheel 310. In yet further examples, other types of resistance mechanisms may be used in place or in combination with a flywheel, such as air-based resistance (e.g., a fan) or hydraulically resisted wheel. In some examples, the resistance mechanism may provide variable resistance based upon the reciprocation frequency of the pedal (e.g., the user's cadence). In some examples, the resistance mechanism may include a fan, alone or in combination of a flywheel, which in the case of the latter may optionally be arranged on the same shaft. Any other suitable resistance mechanism may be used.

As shown for example in FIGS. 1, 2, and 7, the resistance mechanism 300 may include a flywheel 310 operatively associated with a brake assembly (or simply brake) 320 (e.g., a magnetic eddy current brake). One or more components of the brake assembly 320 may be movably positioned with respect to the flywheel 310 to vary the amount of braking force applied by the brake 320. For example, in the case of a magnetic eddy current brake, the one or more magnets of the brake may be movable with respect to the flywheel to vary the amount of the opposing magnetic field to which the flywheel is exposed and thus vary the resistive or braking force on the flywheel. In other examples, a friction brake, which maybe arranged to engage a periphery or a rim of they flywheel, may be used and may similarly include one or more friction members movable to the flywheel vary the friction applied to the flywheel. The operation of the brake 320, such as the relative position of braking elements (e.g., magnet(s), friction pad(s)) may be controlled by a controller 360. The controller 360 may receive electronic inputs from a console of the exercise machine 100 and cause the braking elements to be repositioned responsively, for example by sending electronic commands to an actuation element of the brake 320 or mechanically (e.g., through extension and retraction of a cable 364). In some examples, the brake 320 may be mechanically actuated by the user (e.g., via a lever, knob, etc.) rather than through electronic controls on a console. In yet other examples, the brake 320 may be configured to be controlled both electronically (e.g., during exercise) and/or mechanically (e.g., in an emergency).

Figure 11:
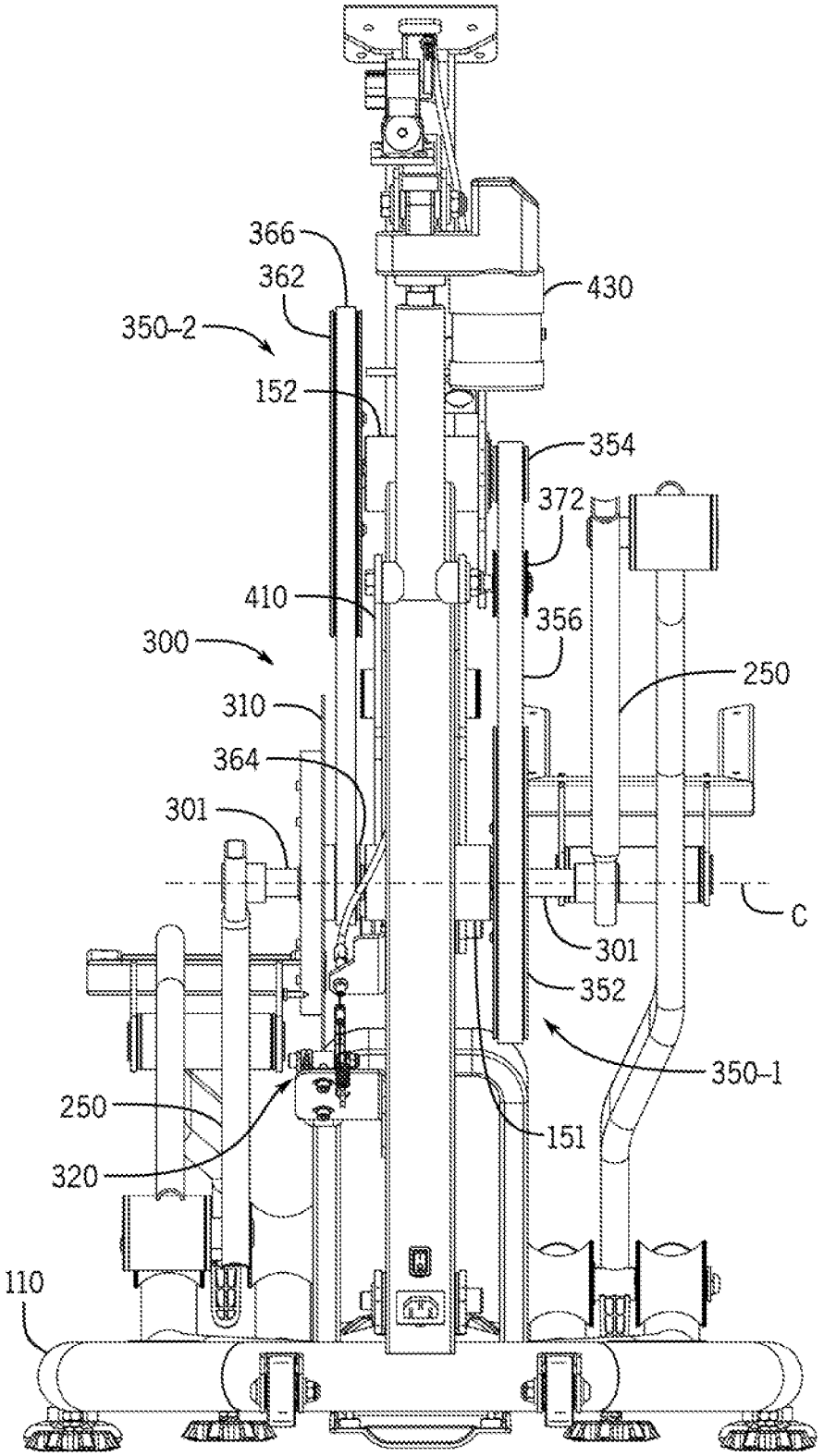
FIG. 11 is a front partial view of the exercise machine in FIG. 1.
Figure 12:
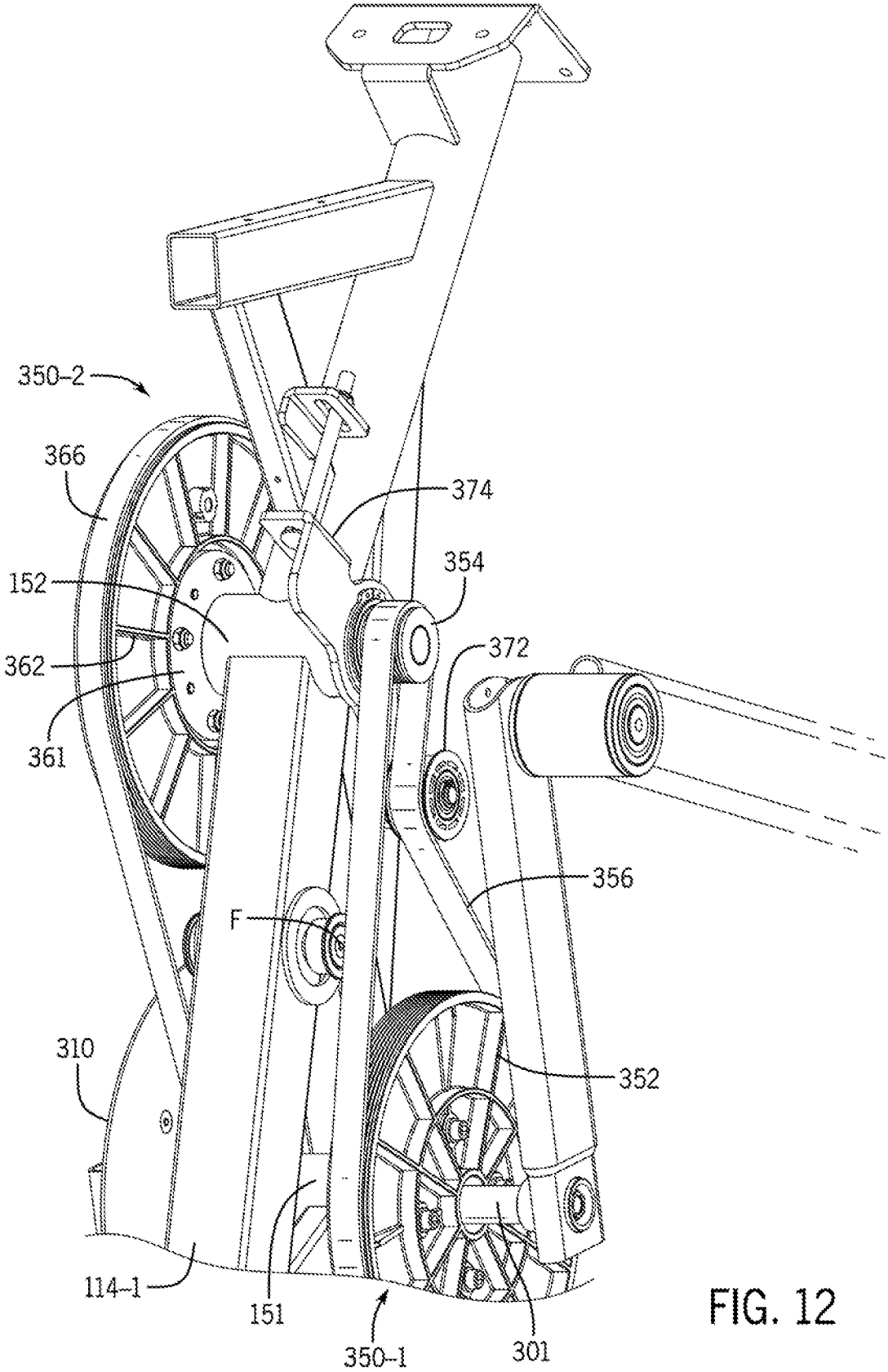
FIG. 12 is an isometric view of a transmission assembly of an exercise machine according to the present disclosure.
Figure 13:
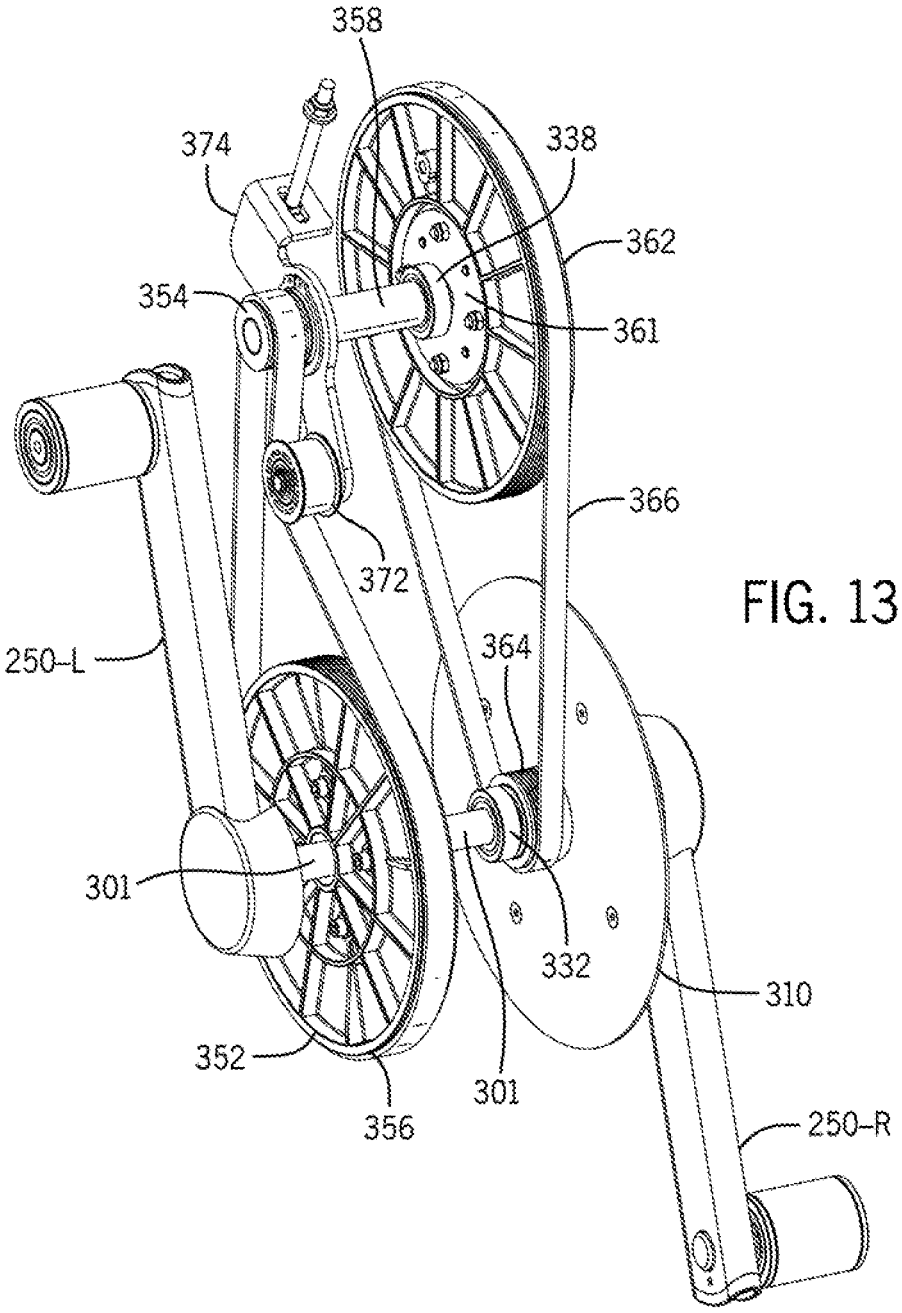
FIG. 13 is another isometric view of the transmission assembly in FIG. 12.

In some examples, the flywheel 310 may be supported by the crank shaft 301 (e.g., coaxially positioned therewith) without the crank shaft 301 directly driving/rotating the flywheel 310. The flywheel 310 may be coupled to the crank shaft 301 via one or more two-way bearings such that rotation of the crank shaft 301 is not directly transmitted to the flywheel 310. Instead, rotation from the crank shaft 301 may be transmitted to the flywheel 310 via a transmission assembly 350. The transmission assembly 350 may be configured to providing a desired gearing ratio, for example to increase the rotational speed from the input (e.g., the crank shaft 301) to the output (e.g., the flywheel 310). The transmission assembly may have a single stage or multiple stages, for example, two stages as shown in FIGS. 11-13. While in the illustrated example, the transmission assembly 350 is shown as a belt-drive assembly using belts and disks/pulleys, it will be understood that in other examples, additionally or alternatively other types of transmission elements, including chain(s) and sprockets, gears, or combinations thereof.

Figure 14:
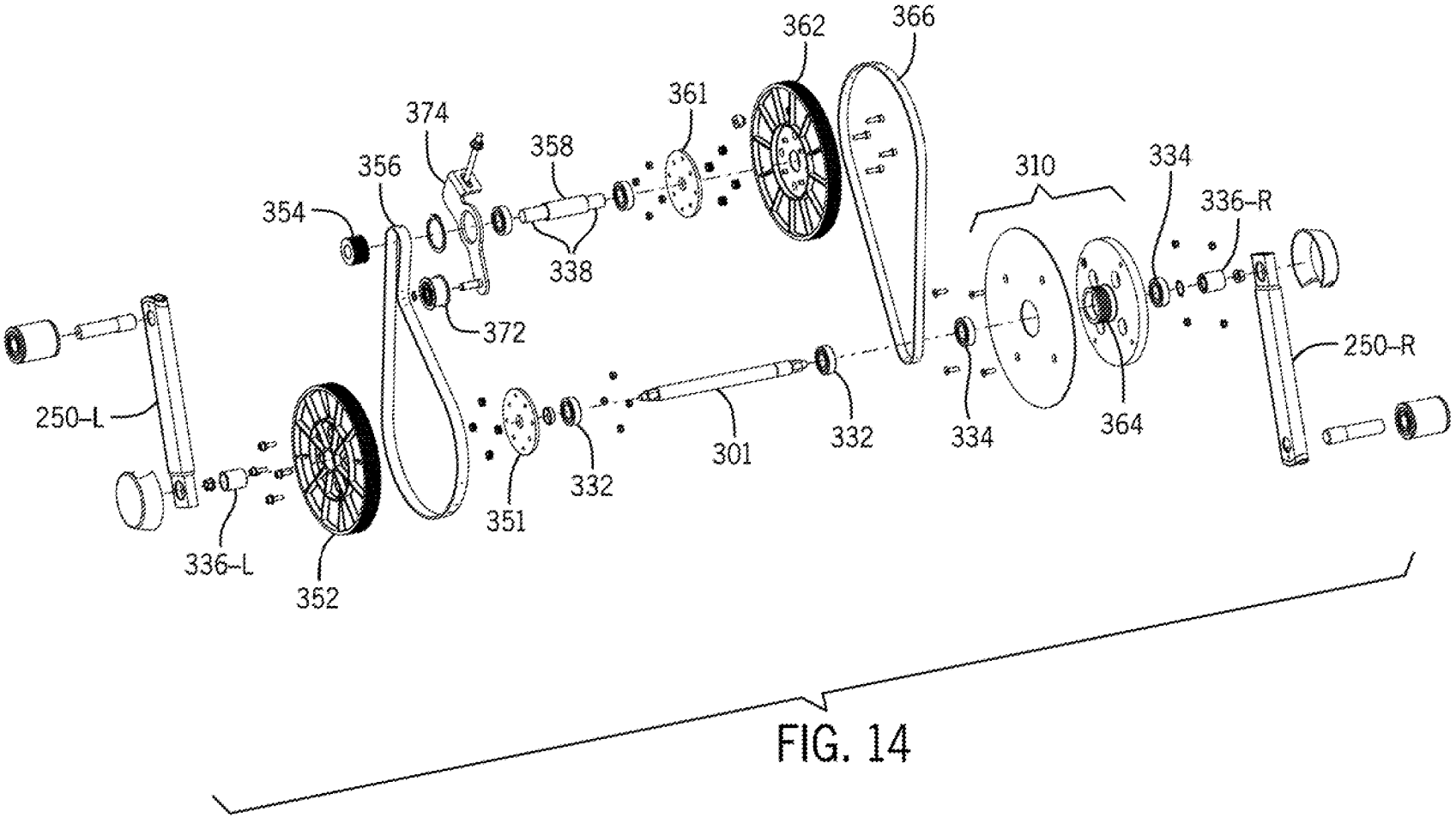
FIG. 14 is an exploded view of the transmission assembly in FIG. 13.
Figure 15:
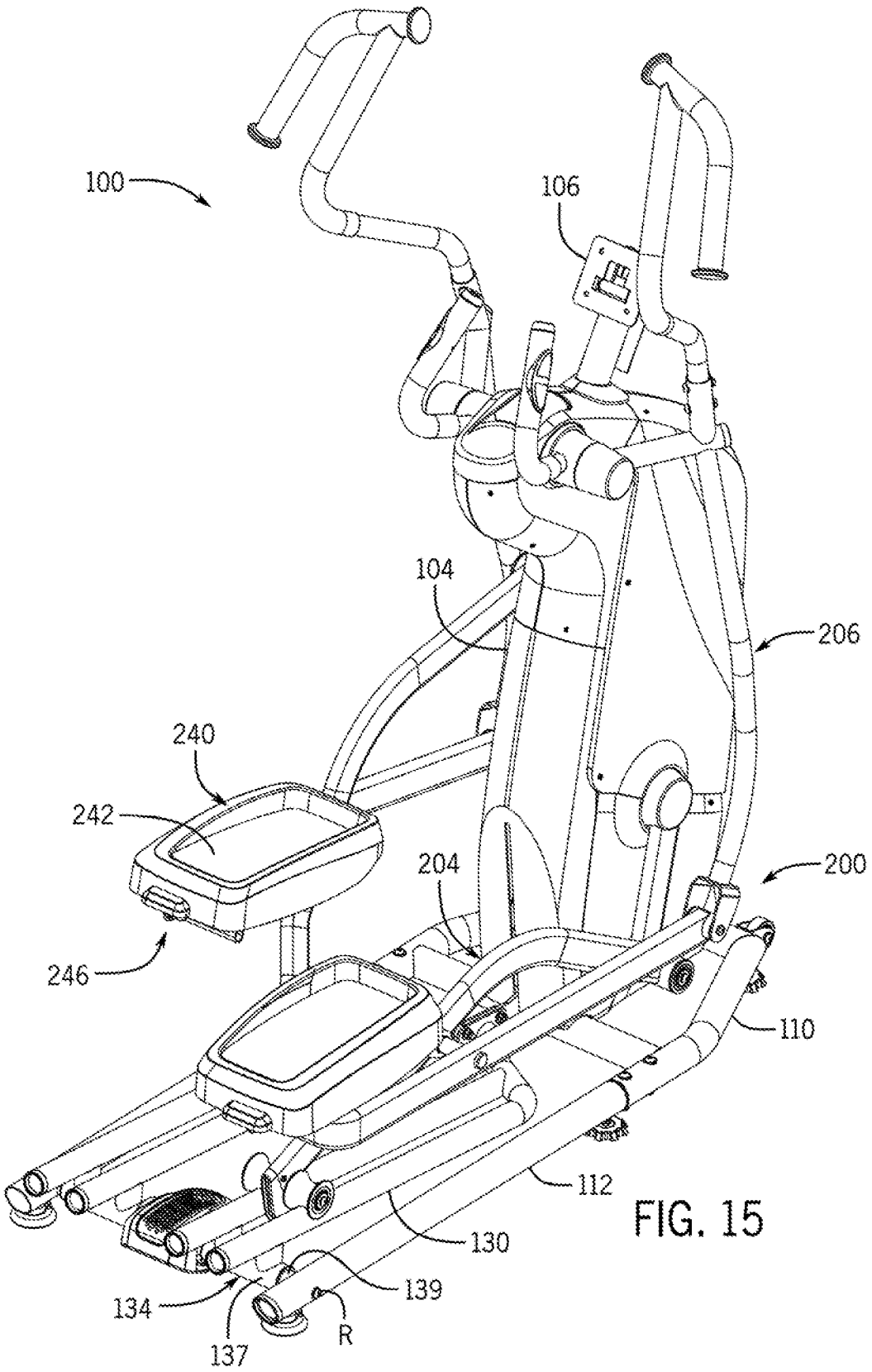
FIGS. 15-20 are rear isometric, front isometric, side, rear, front, and top views of an exercise machine according to the present disclosure, illustrated in these figures with an enclosure around certain movable components of the exercise machine.
Figure 16:
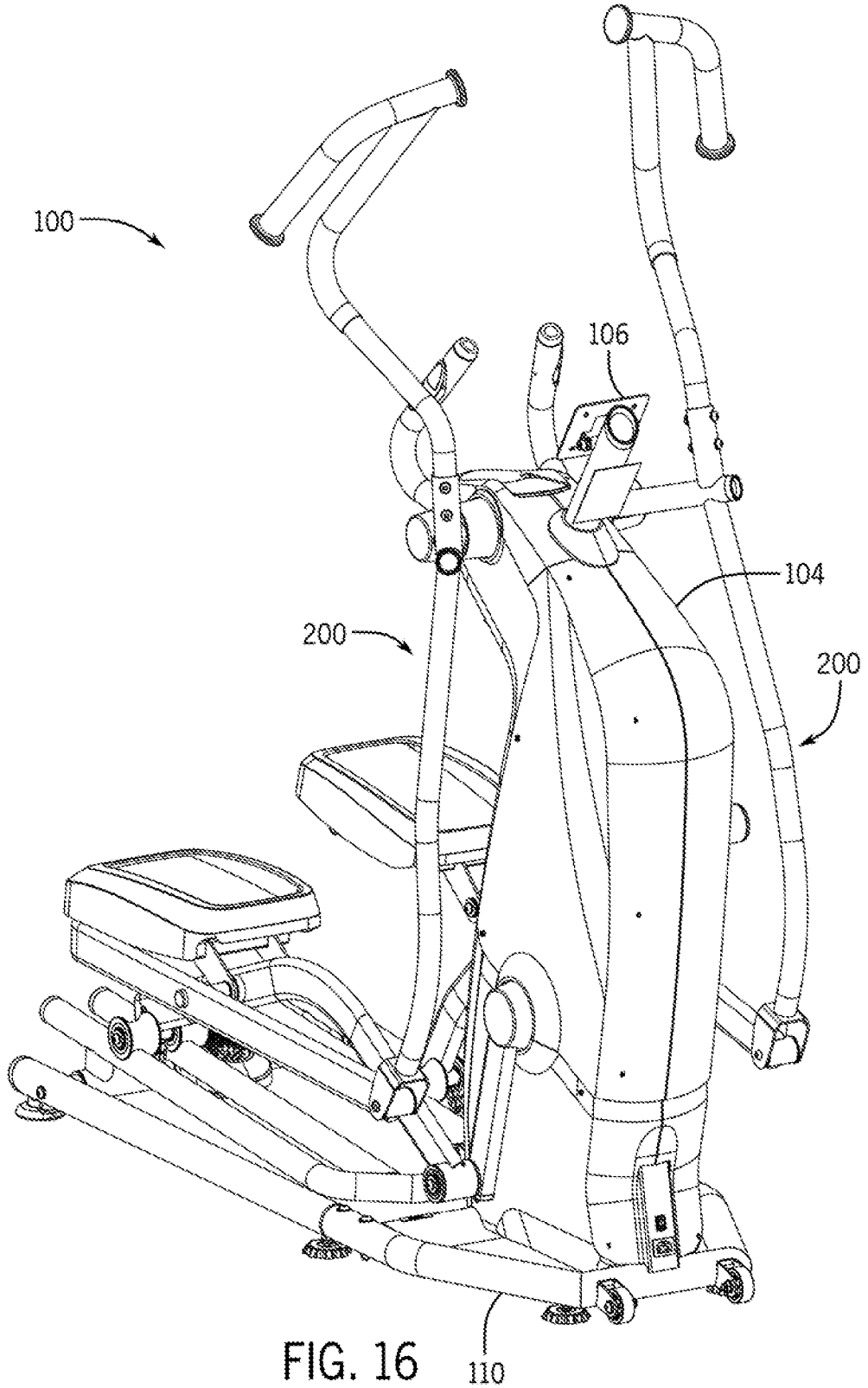
Figure 17:
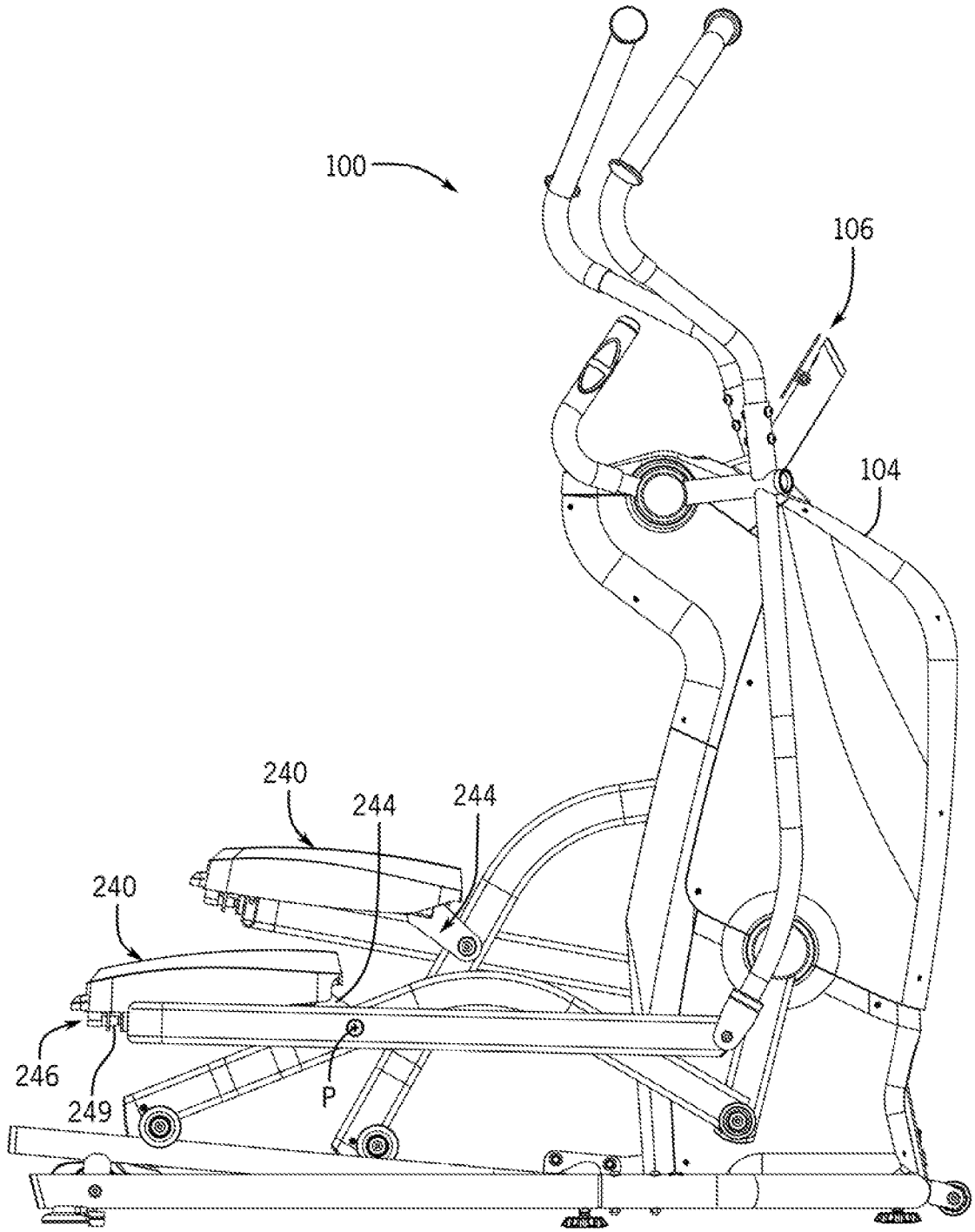
Figure 18:
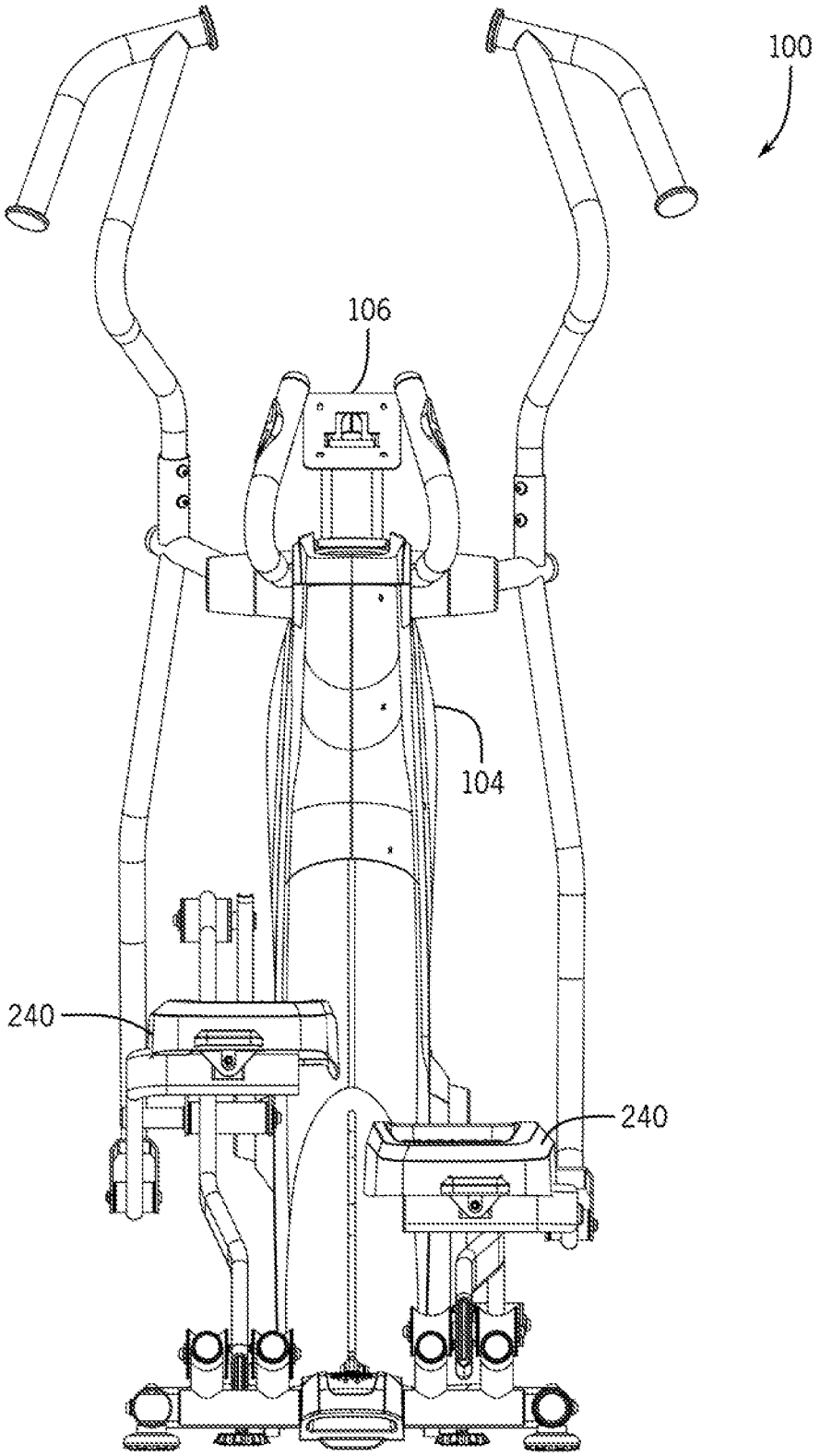
Figure 19:
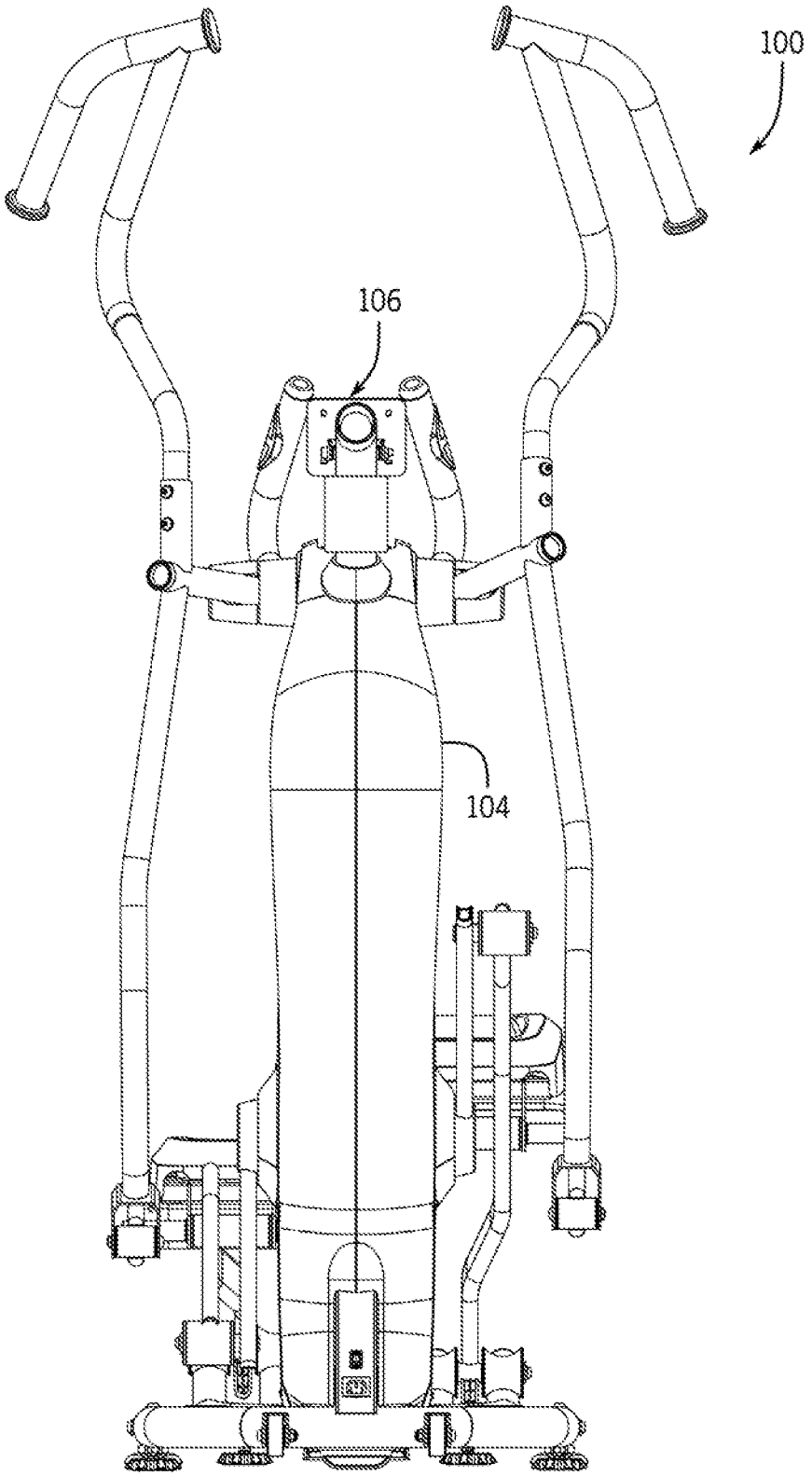
Figure 20:
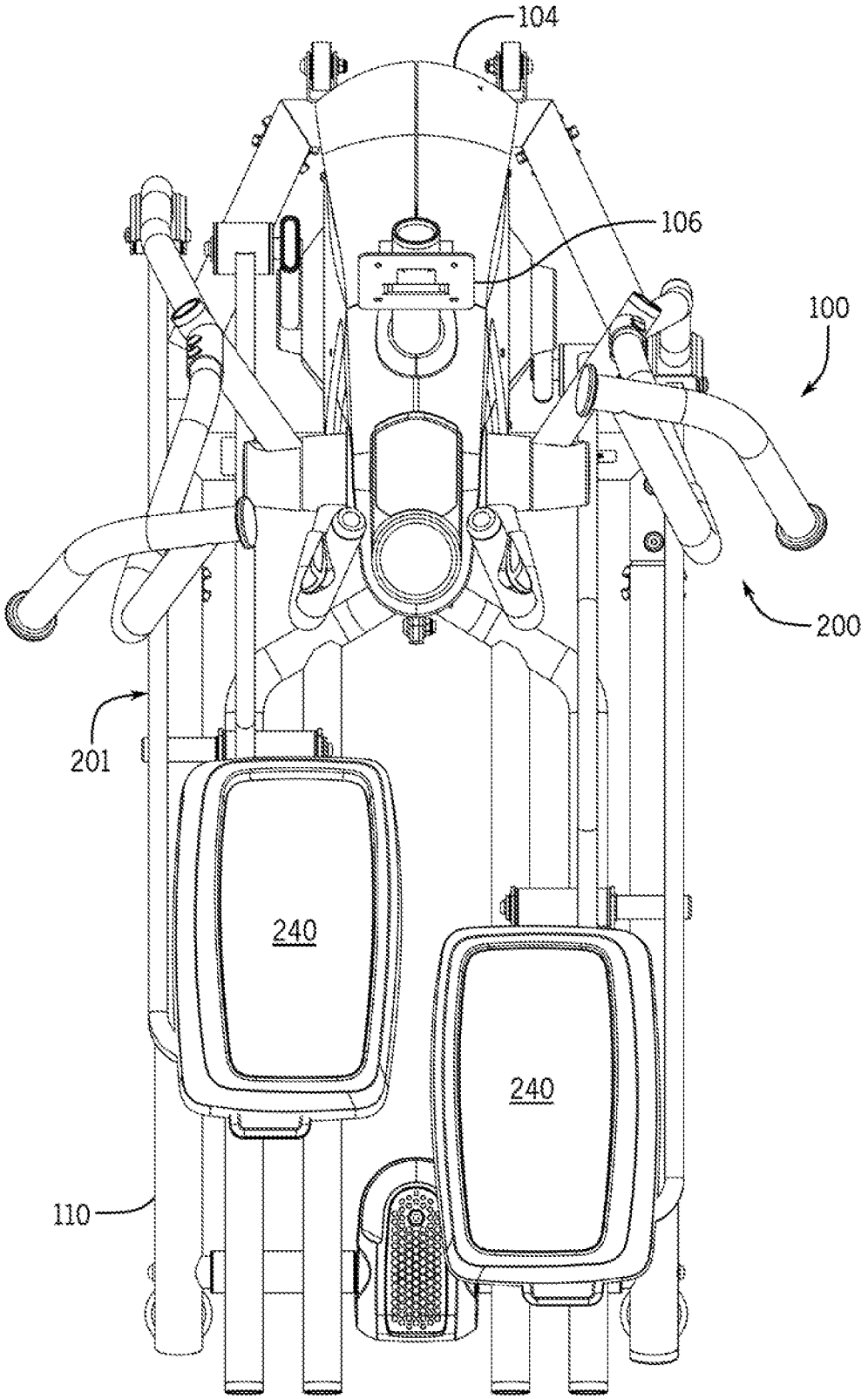

Referring to the example in FIGS. 11-13, the transmission assembly 350 may include a first stage 350-1 and a second stage 350-2, each of which may include an input element and an output element. Referring also to FIG. 14, the transmission assembly 350 may include a first driven member (e.g., first input disk 352) and a first follower member (e.g., first output disk 354) operatively connected, in this case by a first belt 356, to provide a first stage of the transmission assembly 350. In the present example, the first driven member (e.g., first input disk 352) is fixed to the crank shaft 301 such that rotation of the crank shaft 301 causes synchronous rotation of the first driven member (e.g., first input disk 352). In some examples, the first driven member (e.g., first input disk 352) may be fixed to the crank shaft 301, for example by a first plate mount 351, which may be fixed (e.g., welded) to the crank shaft 301 and fixed (e.g., bolted) to the first driven member (e.g., first input disk 352).

As previously described, the crank shaft 301 may be driven by one or more crank arms, for example left and right 250-L and 250-R, each of which is fixed to the respective end of the crank shaft 301 via a respective crank fitting 336-L and 336-R. The crank shaft 301 may be rotatably supported on the frame 110 via one or more two-way bearings 332, which may be used to coaxially rotatably couple the crank shaft 301 to a first tube 151 fixed to the frame 110. One or more additional two-way bearings 334 may be used to rotatably support the flywheel 310 on the crank shaft 301 in a manner that allows the flywheel 310 to rotate independently of the crank shaft 301. Such arrangement may allow the flywheel 310 to be positioned on a common shaft with a geared input (or driven) shaft, which may enable the exercise machine 100 to have a more compact form factor.

The rotation of the first driven member (e.g., first input disk 352) may be transmitted, e.g., via the first belt 356, to the first follower member (e.g., first output disk 354). In the present example, the first follower member (e.g., first follower disk 354) has a smaller diameter than the first driven member (e.g., first input disk 352) and thus the first stage 350-1 gears up (i.e., increases) the rotational speed of the input shaft (i.e., the crank shaft 301). The transmission assembly 350 may further include a second driven member (e.g., second input disk 362) and a second follower member (e.g., second output disk 364) operatively connected, e.g., by a second belt 366, to provide a second stage of the transmission assembly 350. The second driven member (e.g., second input disk 362) may be on a common transmission shaft 358 with the first follower member (e.g., first output disk 354), such that rotation of the first follower member (e.g., first output disk 354) causes synchronous rotation of (or drives) the second driven member (e.g., second input disk 362). The second driven member (e.g., second input disk 362) may be fixed to the transmission shaft 358 via another plate mount 361, which in this case is fixed (e.g., welded) to the transmission shaft 358 and fixed (e.g., bolted) to the second input disk 362. In other examples, the driven disks (e.g., first and second input disks 352 and 362, respectively) may be differently coupled to the respective shaft such as by being directly attached (e.g., bolted) to the shaft. The transmission shaft 358 may be rotatably supported on the frame 110 via one or more two-way bearings 338, which may be used to coaxially rotatably couple the transmission shaft 358 to a second tube 152 fixed to the frame 110. The first and second tubes 151, 152 may be fixed (e.g., rigidly coupled or integrally formed) to the upright frame portion 114 at locations sufficiently spaced apart to avoid interference of the rotatable components.

The rotation of the second driven member (e.g., second input disk 362) may be transmitted, e.g., via the second belt 366, to the second follower member (e.g., second output disk 364). In the present example, the second follower member (e.g., second output disk 364) has a smaller diameter than the second driven member (e.g., second input disk 362) thus further gearing up (i.e., increasing) the rotational speed of the input shaft in the second stage of the transmission assembly 350. The second follower member (e.g., second output disk 364) may be fixed to the flywheel 310 such that rotation of the second follower member (e.g., second output disk 364) causes synchronous rotation of the flywheel 310.

In some embodiments, for example when using belt or chain drives, a tensioner mechanism may be provided to remove slack from a flexible transmission member, such as a belt or chain. For example, an idler 372, which may be implemented pulley, roller, sprocket, other suitable structure and depending on the type of transmission member being used, may be operatively engaged with the flexible transmission member (e.g., the first belt 356). The idler may be supported on a bracket 374, which may be adjustably and/or biasingly coupled to the frame to tension (or biased) the idler 372, in some cases adjustably, toward the flexible transmission member (e.g., first belt 356), which may cause a bend in the flexible transmission member (e.g., first belt 356) towards the inside of the loop. While not shown here, in some examples, an idler may be associated with each of the flexible transmission members of the transmission assembly 350.

FIGS. 15-20 show additional views of an exercise machine 100, shown here with a shroud 104. The shroud 104 may enclose certain components of the exercise machine 100, such as the resistance engine and the lift mechanism, to prevent interference with these components during normal use of the machine, e.g., to reduce the risk of injury and/or provide an aesthetically more pleasing look of the exercise machine 100. In some embodiments, the exercise machine 100 may include a media holder (not shown), which may be mounted (e.g., via mount 106) to the exercise machine 100 and which may be configured to removably coupling an electronic device (e.g., a smart phone or other multi-media device) of the user to the exercise machine. The media holder may be implemented in accordance with any of the examples described in patent application U.S. Ser. No. 16/446,135, assigned to the applicant, and titled "Media Holder for Exercise Machine," which is incorporated herein by reference. In some embodiments, the exercise may additionally or alternatively include a console, which may be integrated into the machine (e.g., at least partially enclosed by the shroud 104), or at least a portion of which, such as a display, may be, removably mounted to the exercise machine 100.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. An exercise machine comprising:

a frame;

a crank shaft rotatably coupled to the frame;

a reciprocating member directly supporting a pedal such that the pedal is constrained to move in a closed loop path, and wherein the reciprocating member is operatively coupled to the crank shaft such that movement of the pedal in the closed loop path causes rotation of the crank shaft;

a reciprocating handle link pivotally coupled to the frame and operatively associated with the crank shaft to drive rotation of the crank shaft, wherein the reciprocating handle link is coupled to the reciprocating member thereby operatively associating the handle link with the crank shaft, wherein the reciprocating handle link is coupled to the reciprocating member via a reciprocating foot link, and wherein the reciprocating foot link is pivotally coupled to the reciprocating member at a location between a first end and a second end of the reciprocating foot link;

a rail pivotally coupled to the frame and movably supporting the reciprocating member, wherein the reciprocating member is configured to translate along the rail when the pedal moves in the closed loop path; and a lift mechanism operatively coupled to the rail for adjusting an incline angle of the rail, wherein the lift mechanism comprises a lever link having a first end operatively coupled to the rail and an opposite second end operatively coupled to a linear actuator, and wherein the lever link is pivotally coupled to the frame at a location between the first and second ends of the lever link.

2. The exercise machine of claim 1, further comprising a resistance mechanism operatively coupled to the crank shaft to resist rotation of the crank shaft.

3. The exercise machine of claim 2, wherein the resistance mechanism comprises a flywheel rotatably supported by the frame.

4. The exercise machine of claim 3, further comprising a plurality of transmission members pivotally supported on the frame, wherein rotation of the crank shaft causes at least one of the transmission members to rotate synchronously with the crank shaft.

5. The exercise machine of claim 4, wherein the least one of the transmission members that rotates synchronously with the crank shaft is coaxially positioned to the flywheel.

6. The exercise machine of claim 5, wherein one or more of the transmission members are rotatably supported on a transmission shaft spaced apart from the crank shaft.

7. The exercise machine of claim 6, wherein the lever arm is coupled to the frame at a location between the crank shaft and the transmission shaft.

8. The exercise machine of claim 3, wherein the flywheel is supported by the crank shaft.

9. The exercise machine of claim 8, wherein the flywheel is supported on the crank shaft by one or more two-way bearings.

10. The exercise machine of claim 8, wherein the crank shaft is operatively coupled to the flywheel to cause the flywheel to rotate responsive to but asynchronously with the crank shaft.

11. The exercise machine of claim 3, further comprising a transmission assembly operatively coupled between the crank shaft and the flywheel to cause rotation of the flywheel at an output rotational speed greater than an input rotational speed to the transmission assembly.

12. The exercise machine of claim 11, wherein the transmission assembly comprises a two-stage belt-drive assembly.

13. The exercise machine of claim 1, wherein the frame includes a base for contact with a support surface and an upright support extending from the base, and wherein the rail is pivotally coupled to the base and the lever link is pivotally coupled to the upright support.

14. The exercise machine of claim 13, wherein the linear actuator is coupled to the upright support at a location above a fulcrum of the lever link.

15. The exercise machine of claim 13, wherein the linear actuator is coupled to the frame at a location below a fulcrum of the lever link.

16. The exercise machine of claim 1, wherein a first end of the reciprocating member is slidably supported on the rail and a second end of the reciprocating member is configured to rotate about the crank shaft when the pedals move along the closed loop path.

17. The exercise machine of claim 1, wherein the reciprocating member is coupled to the crank shaft via a crank arm.

18. The exercise machine of claim 1, wherein the linear actuator is coupled to frame such that an extension of the linear actuator increases the incline angle of the rail.

19. The exercise machine of claim 1, further comprising a link arm coupling the first end of the lever link to the rail.

20. The exercise machine of claim 1, wherein the pedal is pivotally coupled to the reciprocating member.

21. An exercise machine comprising:

a frame;

a crank shaft rotatably supported on the frame;

a flywheel rotatably supported on the frame and configured to rotate responsive to rotation of the crank shaft but at a different rotational speed than the crank shaft;

a reciprocating member directly supporting a pedal, the reciprocating member having a first end movably supported by the frame and constrained to move in a reciprocating back and forth motion responsive to movement of the pedal, the reciprocating member having an opposite second end operatively coupled to the crank shaft to cause rotation of the crank shaft responsive to the reciprocating back and forth motion of the first end;

a reciprocating handle link pivotally coupled to the frame and operatively associated with the crank shaft to drive rotation of the crank shaft, wherein the reciprocating handle link is coupled to the reciprocating member thereby operatively associating the handle link with the crank shaft, wherein the reciprocating handle link is coupled to the reciprocating member via a reciprocating foot link, and wherein the reciprocating foot link is pivotally coupled directly to the reciprocating member at a location between a first end and a second end of the reciprocating foot link;

a rail pivotally coupled to the frame and movably supporting the reciprocating member, wherein the reciprocating member is configured to translate along the rail responsive to movement of the pedal; and a lift mechanism pivotally coupled to a forward end of the rail for adjusting an incline angle of the rail.

22. The exercise machine of claim 21 further comprising a transmission assembly operatively coupled between the crank shaft and the flywheel to drive rotation of the flywheel at an output rotational speed greater than an input rotational speed to the transmission assembly.

23. The exercise machine of claim 22, wherein the transmission assembly is a two-stage belt-drive assembly.

24. The exercise machine of claim 21, further comprising a crank arm coupling the second end of the reciprocating member to the crank shaft.

25. The exercise machine of claim 21, wherein the frame includes a base for contact with a support surface and an upright support extending from the base.

26. An exercise machine comprising:

a frame;

a crank shaft rotatably coupled to the frame;

a reciprocating member movably supported by the frame such that a first end of the reciprocating member rotates the crankshaft responsive to movement of the reciprocating member, the reciprocating member directly supporting a pedal;

a reciprocating handle link pivotally coupled to the frame and operatively associated with the crank shaft to drive rotation of the crank shaft, wherein the reciprocating handle link is coupled to the reciprocating member thereby operatively associating the handle link with the crank shaft, wherein the reciprocating handle link is coupled to the reciprocating member via a reciprocating foot link, and wherein the reciprocating foot link is pivotally coupled directly to the reciprocating member at a location between a first end and a second end of the reciprocating foot link;

a rail pivotally coupled to the frame and movably supporting a second end of the reciprocating member such that the second end of the reciprocating member translates along the rail when the first end rotates the crankshaft; and a lift mechanism pivotally coupled to a forward end of the rail to selectively adjust an incline angle of the rail such that an extension stroke of the lift mechanism lowers the rail and a retraction stroke of the lift mechanism raises the rail.

27. The exercise machine of claim 26, a lever link having a first end operatively coupled to the rail and an second end coupled to a free end of an extendible rod, wherein the lever link is pivotally coupled to the frame at a fulcrum, wherein a distance between the fulcrum and the first end is greater than a distance between the fulcrum and the second end such that movement of the free end of the extendible rod by a first travel distance causes the second end of the lever link to move a second travel distance greater than the first travel distance, and wherein the lever link is pivotally coupled to an upright support of the frame.

28. The exercise machine of claim 27, further comprising a flywheel associated with a brake mechanism, wherein the flywheel is coupled to the frame at a location below the fulcrum.

29. The exercise machine of claim 28, further comprising a transmission assembly that transmits the rotation of the crankshaft to the flywheel, wherein the transmission assembly includes at least one disk rotatably coupled to the frame at a location above the fulcrum.

30. The exercise machine of claim 27, wherein the free end of the rod is oriented towards a base of the exercise machine such that extension of the rod causes an increase in the incline angle of the rail.

31. The exercise machine of claim 27, wherein the free end of the rod is oriented away from a base of the exercise machine such that extension of the rod causes a decrease in the incline angle of the rail.

32. The exercise machine of claim 26, wherein the pedal is pivotally coupled to the reciprocating member such that the pedal is constrained to move in a closed loop path.

* * * * *